US011391020B2

(12) United States Patent
Ishii et al.

(10) Patent No.: US 11,391,020 B2
(45) Date of Patent: Jul. 19, 2022

(54) WORK MACHINE

(71) Applicant: Hitachi Construction Machinery Co., Ltd., Tokyo (JP)

(72) Inventors: Hiroki Ishii, Tsuchiura (JP); Shinjiro Yamamoto, Ami-machi (JP); Masamichi Itou, Toride (JP); Yasutaka Tsuruga, Ryuugasaki (JP); Shinya Imura, Toride (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/435,602

(22) PCT Filed: May 20, 2020

(86) PCT No.: PCT/JP2020/019987
§ 371 (c)(1),
(2) Date: Sep. 1, 2021

(87) PCT Pub. No.: WO2021/059584
PCT Pub. Date: Apr. 1, 2021

(65) Prior Publication Data

US 2022/0154741 A1 May 19, 2022

(30) Foreign Application Priority Data

Sep. 26, 2019 (JP) ..... JP2019-176104

(51) Int. Cl.
*E02F 9/22* (2006.01)
*F15B 11/16* (2006.01)
*F15B 13/042* (2006.01)

(52) U.S. Cl.
CPC ..... *E02F 9/2285* (2013.01); *F15B 11/16* (2013.01); *F15B 13/0422* (2013.01);
(Continued)

(58) Field of Classification Search
CPC ... E02F 9/2285; F15B 11/16; F15B 2211/329; F15B 2211/355; F15B 2211/36;
(Continued)

(56) References Cited

U.S. PATENT DOCUMENTS 5,735,065 A 4/1998 Yamagata et al.
5,784,944 A * 7/1998 Tozawa ..... F15B 20/00 91/461
(Continued)

FOREIGN PATENT DOCUMENTS

JP 3091667 B2 9/2000
JP 2017-8501 A 1/2017
(Continued)

OTHER PUBLICATIONS

International Search Report (PCT/ISA/210) issued in PCT Application No. PCT/JP2020/019987 dated Aug. 11, 2020 with English translation (six (6) pages).
(Continued)

*Primary Examiner* — Dustin T Nguyen
(74) *Attorney, Agent, or Firm* — Crowell & Moring LLP

(57) ABSTRACT

There is provided a work machine that can limit operation of a work device by MC, and improves the responsiveness of a hydraulic actuator to operation of an operation device by an operator, and ensures operability equivalent to that of a work machine that does not have MC functions, and allows the hydraulic actuator for which the operation device is not being operated to automatically operate in either direction of the operation directions thereof. For this purpose, a drive system includes a selector valve 203*a* disposed between a secondary port 134*a* of an operation device 45*a* and a flow control valve 15*a* and between a proportional solenoid valve 54*a* and the flow control valve 15*a* and a selector valve 203*b* disposed between a secondary port 134*b* of the operation
(Continued)

device 45*a* and the flow control valve 15*a* and between a proportional solenoid valve 54*b* and the flow control valve 15*a*. A controller 40 switches the selector valves 203*a* and 203*b* to either one of a first position and a second position on the basis of signals from pressure sensors 70*a* and 70*b* and pressure sensors 200*a* and 200*b* and target operation set in advance regarding the selector valves 203*a* and 203*b*.

7 Claims, 14 Drawing Sheets

(52) U.S. Cl.
CPC ... *F15B 2211/329* (2013.01); *F15B 2211/355* (2013.01); *F15B 2211/36* (2013.01); *F15B 2211/575* (2013.01); *F15B 2211/6316* (2013.01); *F15B 2211/6355* (2013.01); *F15B 2211/67* (2013.01)

(58) Field of Classification Search
CPC ..... F15B 2211/575; F15B 2211/6316; F15B 2211/6355; F15B 2211/67; F15B 13/0422
See application file for complete search history.

(56) References Cited

U.S. PATENT DOCUMENTS 5,960,378 A * 9/1999 Watanabe ..... E02F 3/32 37/415
6,079,131 A * 6/2000 Oshina ..... E02F 9/265 37/348
10,590,963 B2 * 3/2020 Kondo ..... E02F 9/2235
10,794,046 B2 * 10/2020 Imura ..... E02F 9/2221
2016/0369480 A1 12/2016 Mizuochi et al.
2019/0169818 A1 * 6/2019 Narikawa ..... E02F 3/437
2020/0002914 A1 1/2020 Yoshida et al.
2020/0024821 A1 1/2020 Takeuchi et al.
2020/0032482 A1 1/2020 Meguriya et al.
2020/0277752 A1 * 9/2020 Igarashi ..... E02F 9/26

FOREIGN PATENT DOCUMENTS

JP 2018-80510 A 5/2018
JP 2018-80762 A 5/2018
JP 2019-52472 A 4/2019
JP 2019-56247 A 4/2019
WO WO 2014/192190 A1 12/2014

OTHER PUBLICATIONS

Japanese-language Written Opinion (PCT/ISA/237) issued in PCT Application No. PCT/JP2020/019987 dated Aug. 11, 2020 (three (3) pages).
International Preliminary Report on Patentability (PCT/IB/338 & PCT/IB/373) issued in PCT Application No. PCT/JP2020/019987 dated Apr. 7, 2022, including English translation of document C2 (Japanese-language Written Opinion (PCT/ISA/237) filed on Sep. 1, 2021) (five (5) pages).

* cited by examiner

WORK MACHINE

TECHNICAL FIELD

The present invention relates to a work machine that carries out front device control such as area limiting excavation control, for example.

BACKGROUND ART

There is machine control (Machine Control: referred to as MC hereinafter) as a technique to improve the work efficiency of a work machine (for example, hydraulic excavator) including a work device (for example, front work implement) driven by a hydraulic actuator. The MC is a technique to carry out operation assist of an operator by carrying out semiautomatic control by which the work device is caused to operate according to a condition defined in advance when an operation device is operated by the operator.

When the MC works, operation of a work device (for example, front work implement) is limited in such a manner that the lower side of an excavation target surface is not excavated.

In patent document 1, a proportional solenoid valve is disposed on an operation signal line of an operation device and operation of a work device is limited by reducing an operation pilot pressure output from the operation device by the proportional solenoid valve such that the velocity of the work device may be kept from exceeding a limit value.

In patent document 2, when the MC is not carried out, a selector valve is switched to a first position to interrupt connection between an operation signal line of an operation device and a pressure reducing line including a proportional solenoid valve and connect the operation signal line directly to a signal input line of a corresponding flow control valve. Thereby, an operation pilot pressure output from the operation device is kept from passing through the proportional solenoid valve. When the MC is carried out, the selector valve is switched to a second position to connect the operation signal line to the signal input line of the flow control valve through the pressure reducing line and reduce the operation pilot pressure output from the operation device by the proportional solenoid valve. Thereby, operation of a work device is limited.

Furthermore, in patent document 1 and patent document 2, an operation signal line of boom raising of the operation device and a control signal line that introduces a control pilot pressure generated by the proportional solenoid valve are connected to each other through a shuttle valve, and the higher pressure of an operation pilot pressure of boom raising output from the operation device and the control pilot pressure output from the proportional solenoid valve is introduced to a signal input line of the boom raising side in the flow control valve. This allows execution of automatic boom raising and boom raising through operation of the operation device by an operator.

PRIOR ART DOCUMENT

Patent Documents

Patent Document 1: Japanese Patent No. 3091667

Patent Document 2: JP-2018-080762-A

SUMMARY OF THE INVENTION

Problem to be Solved by the Invention

In the technique described in patent document 1, operation limitation of the work device by the MC and automatic boom raising by the MC can be carried out. However, the proportional solenoid valve exists on the operation signal line. Therefore, when the MC is not carried out, pressure loss occurs due to passing of the operation pilot pressure output from the operation device through the proportional solenoid valve. For this reason, there is a problem that the responsiveness of a hydraulic actuator to operation of the operation device by an operator lowers and it is impossible to obtain operability equivalent to that of a work machine that does not have MC functions.

Furthermore, in patent document 1, a proportional solenoid valve is not disposed in the operation pilot pressure circuit of the boom lowering side and therefore it is impossible to carry out automatic boom lowering by the MC.

In the technique described in patent document 2, when the MC is not carried out, the selector valve is switched to the first position to connect the operation signal line directly to the signal input line of the corresponding flow control valve, and the operation pilot pressure output from the operation device does not pass through the proportional solenoid valve. Thus, pressure loss does not occur and the responsiveness of a hydraulic actuator to operation of the operation device by an operator is improved, thus operability equivalent to that of a work machine that does not have MC functions is obtained.

However, also in patent document 2, a proportional solenoid valve is not disposed in the operation pilot pressure circuit of the boom lowering side and therefore it is impossible to carry out automatic boom lowering by the MC.

Here, boom lowering operation will be described by taking horizontal excavation by the MC as an example.

In the horizontal excavation by the MC, an arm is operated to the crowding side by operating an operation device of the arm. At this time, boom raising operation is automatically carried out in such a manner that the bucket claw tip is along an excavation target surface set in advance in line with the operation of the arm. After the arm becomes a posture perpendicular to the excavation target surface, the bucket claw tip operates in such a direction as to get further away from the excavation target surface due to arm crowding operation. Therefore, the boom raising operation becomes unnecessary. However, boom lowering operation needs to be carried out in order to cause the bucket claw tip to operate along the target surface.

In patent documents 1 and 2, an operator operates the operation device in the boom lowering direction and the output operation pilot pressure is reduced by the proportional solenoid valve. Thereby, boom lowering operation is limited in such a manner that the bucket claw tip does not enter the lower side of the excavation target surface, thus the horizontal excavation is implemented.

However, it is desired to automate the boom lowering operation such that the horizontal excavation in the MC can be carried out with only the operation device of the arm in the future. In this case, it is necessary that the boom lowering operation can be automatically carried out in the state in which the operation device of the boom is not being operated. In patent documents 1 and 2, the operation pilot pressure generated by operating the operation device of the boom in the lowering direction is employed as input to the proportional solenoid valve. Therefore, it is impossible to allow the boom lowering operation in the state in which the operation device of the boom is not being operated in the lowering direction.

Furthermore, if the circuit configuration of boom raising that allows execution of operation without operating the operation device is applied also to the boom lowering side, it becomes possible to allow the boom lowering operation in the state in which the operation device of the boom is not being operated in the lowering direction. However, the higher pressure of the control pilot pressure output from the proportional solenoid valve and the operation pilot pressure of boom lowering of the operation device is introduced to a signal input line of boom lowering in the flow control valve. Therefore, there is a problem that, although a signal for limiting operation of the work device is output to the proportional solenoid valve, the operation pilot pressure of boom lowering of the operation device is introduced to the signal input line of the flow control valve as it is without being reduced by the proportional solenoid valve and it becomes impossible to limit the operation of the work device.

An object of the present invention is to provide a work machine that can limit operation of a work device by the MC, and improves the responsiveness of a hydraulic actuator to operation of an operation device by an operator, and ensures operability equivalent to that of a work machine that does not have MC functions, and allows the hydraulic actuator for which the operation device is not being operated to automatically operate in either direction of the operation directions thereof.

Means for Solving the Problem

In order to solve such a problem, the present invention provides a work machine comprising: a work device; a plurality of hydraulic actuators that drive the work device; a plurality of operation devices that generate a plurality of operation pilot pressures to instruct operations of the plurality of hydraulic actuators; a plurality of flow control valves that are driven by the plurality of operation pilot pressures and control flow rates of hydraulic fluids supplied to the plurality of hydraulic actuators; a plurality of proportional solenoid valves that generate a plurality of control pilot pressures independently of the plurality of operation devices; a plurality of operation pressure sensors that sense the plurality of operation pilot pressures generated by the plurality of operation devices; a work device posture sensor that senses posture of the work device; and a controller that controls the plurality of proportional solenoid valves on a basis of signals from the plurality of operation pressure sensors and the work device posture sensor, the plurality of operation devices including a first operation device that instructs operation of a first hydraulic actuator in the plurality of hydraulic actuators, the plurality of flow control valves including a first flow control valve that is driven by an operation pilot pressure generated by the first operation device and controls a flow rate of a hydraulic fluid supplied to the first hydraulic actuator, the first operation device having a first output port that outputs a first operation pilot pressure to instruct operation of the first hydraulic actuator in a first direction and a second output port that outputs a second operation pilot pressure to instruct operation of the first hydraulic actuator in a second direction, the plurality of operation pressure sensors having a first operation pressure sensor that senses the first operation pilot pressure and a second operation pressure sensor that senses the second operation pilot pressure, wherein the plurality of proportional solenoid valves have a first proportional solenoid valve that generates a first control pilot pressure to instruct operation of the first hydraulic actuator in the first direction and a second proportional solenoid valve that generates a second control pilot pressure to instruct operation of the first hydraulic actuator in the second direction, the work machine further comprises a plurality of control pressure sensors that sense the plurality of control pilot pressures generated by the plurality of proportional solenoid valves and include a first control pressure sensor that senses the first control pilot pressure generated by the first proportional solenoid valve and a second control pressure sensor that senses the second control pilot pressure generated by the second proportional solenoid valve, a first selector valve disposed between the first output port of the first operation device and the first flow control valve and between the first proportional solenoid valve and the first flow control valve, and a second selector valve disposed between the second output port of the first operation device and the first flow control valve and between the second proportional solenoid valve and the first flow control valve, the first selector valve has a first position to interrupt connection between the first proportional solenoid valve and the first flow control valve and connect the first output port of the first operation device to the first flow control valve and a second position to interrupt connection between the first output port of the first operation device and the first flow control valve and connect the first proportional solenoid valve to the first flow control valve, the second selector valve has a first position to interrupt connection between the second proportional solenoid valve and the first flow control valve and connect the second output port of the first operation device to the first flow control valve and a second position to interrupt connection between the second output port of the first operation device and the first flow control valve and connect the second proportional solenoid valve to the first flow control valve, and the controller is configured to switch the first and second selector valves to either one of the first position and the second position on a basis of signals from the first and second operation pressure sensors and the first and second control pressure sensors and a target operation set in advance regarding the first and second selector valves.

By such configuration in which the first selector valve and the second selector valve are disposed and the first and second selector valves are switched to either one of the first position and the second position as above, operation of the work device can be limited by the MC and the responsiveness of the hydraulic actuator to operation of the operation device by the operator is improved. In addition, operability equivalent to that of a work machine that does not have MC functions is ensured and it becomes possible to automatically operate the hydraulic actuator for which the operation device is not being operated in either of the operation directions thereof.

Specifically, for example, by switching the first selector valve to the second position and controlling the first proportional solenoid valve to generate the first control pilot pressure obtained by reducing the first operation pilot pressure sensed by the first operation pressure sensor, operation of the first hydraulic actuator in the first direction can be limited and it becomes possible to limit operation of the work device by the MC. This is the same also in the case in which the second selector valve is switched to the second position.

Furthermore, for example, by causing the first selector valve to be switched to the first position when the operator operates the first operation device in the MC or when the MC is not carried out, the operation pilot pressure output from the first output port of the first operation device is introduced to the first flow control valve without passing through the first proportional solenoid valve. Due to this, pressure loss as in the conventional case in which the operation pilot pressure passes through the proportional solenoid valve does not occur, thus the responsiveness of the first hydraulic actuator to operation of the first operation device by the operator can be improved and operability equivalent to that of a work machine that does not have MC functions can be ensured. This is the same also in the case in which the second selector valve is caused to be switched to the first position.

Moreover, the first hydraulic actuator can be automatically operated in the first direction by switching the first selector valve to the second position and controlling the first proportional solenoid valve to generate the first control pilot pressure based on the MC. Similarly, the first hydraulic actuator can be automatically operated in the second direction by switching the second selector valve to the second position and controlling the second proportional solenoid valve to generate the second control pilot pressure based on the MC. Due to this, it becomes possible to automatically operate the hydraulic actuator for which the operation device is not being operated in either direction of the operation directions thereof.

Advantages of the Invention

According to the present invention, operation of the work device can be limited by the MC and the responsiveness of the hydraulic actuator to operation of the operation device by the operator is improved. In addition, operability equivalent to that of a work machine that does not have MC functions is ensured and it becomes possible to automatically operate the hydraulic actuator for which the operation device is not being operated in either direction of the operation directions thereof.

MODES FOR CARRYING OUT THE INVENTION

Embodiments of the present invention will be described below according to the drawings. In the following description, a hydraulic excavator including a bucket 10 as work equipment (attachment) at the tip of a work device will be exemplified. However, the present invention may be applied to a work machine including an attachment other than the bucket. Moreover, application to a work machine other than the hydraulic excavator is also possible as long as it is what has an articulated work device configured by joining plural link members (attachment, arm, boom, and so forth).

First Embodiment

<Work Machine>

Figure 1:
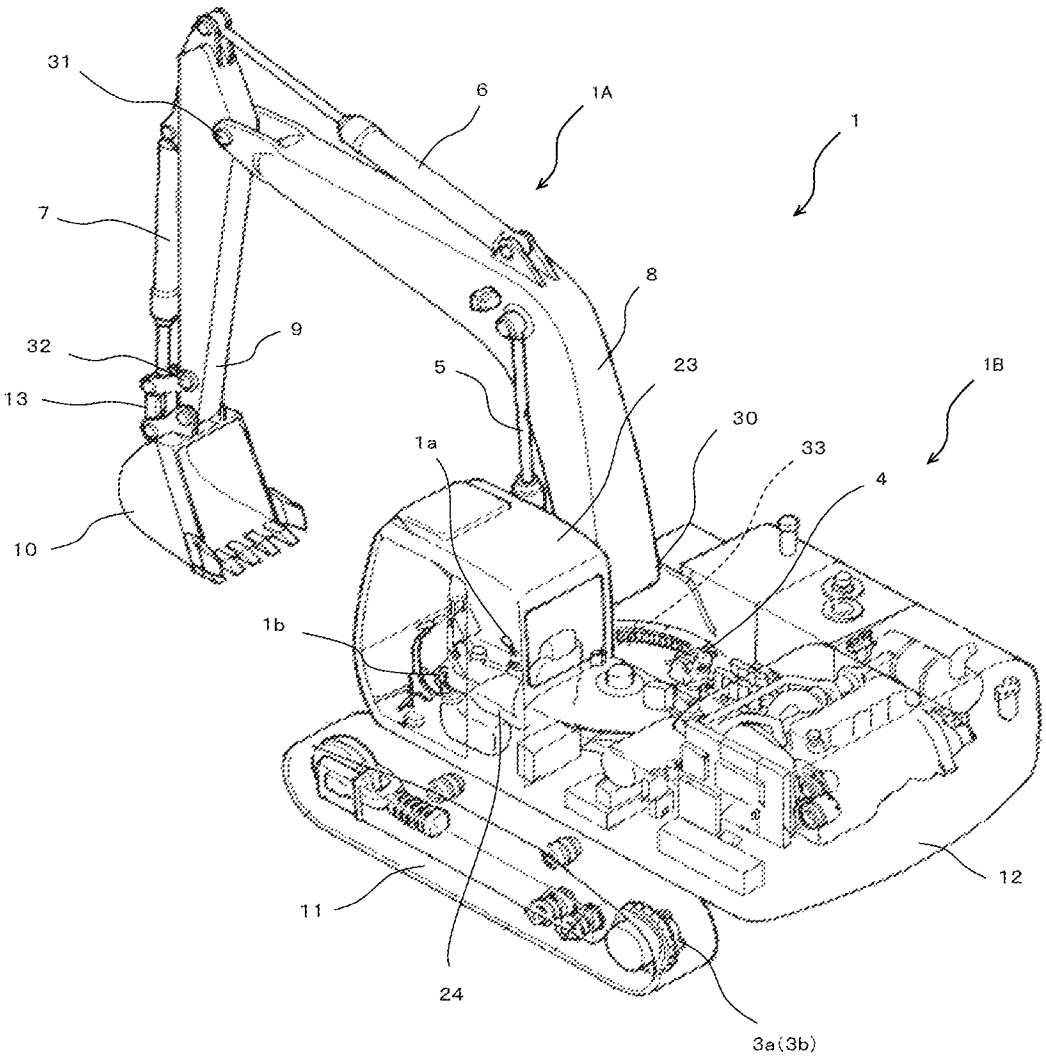
FIG. 1 is a configuration diagram of a hydraulic excavator that is a work machine in a first embodiment of the present invention.

FIG. 1 is a configuration diagram of a hydraulic excavator that is a work machine in a first embodiment of the present invention.

In FIG. 1, a hydraulic excavator 1 is composed of an articulated front work device (hereinafter, often referred to simply as work device) 1A and a machine body 1B. The machine body 1B has a lower track structure 11 that travels by left and right travelling hydraulic motors 3*a* and 3*b* and an upper swing structure 12 that is attached onto the lower track structure 11 and is swung by a swing hydraulic motor 4. The front work device 1A is configured by joining plural driven members (boom 8, arm 9, and bucket 10) that are each pivoted in the perpendicular direction. The base end of the boom 8 is pivotally supported at the front part of the upper swing structure 12 with the interposition of a boom pin. The arm 9 is pivotally joined to the tip of the boom 8 with the interposition of an arm pin and the bucket 10 is pivotally joined to the tip of the arm 9 with the interposition of a bucket pin. The boom 8 is driven by a hydraulic cylinder 5 (hereinafter, referred to as boom cylinder). The arm 9 is driven by a hydraulic cylinder 6 (hereinafter, referred to as arm cylinder). The bucket 10 is driven by a hydraulic cylinder 7 (hereinafter, referred to as bucket cylinder).

A boom angle sensor 30 is attached to the boom pin and an arm angle sensor 31 is attached to the arm pin and a bucket angle sensor 32 is attached to a bucket link 13 such that the pivot angles of the boom 8, the arm 9, and the bucket 10 can be measured. A machine body inclination angle sensor 33 that senses the inclination angle of the upper swing structure 12 (machine body 1B) with respect to a reference plane (for example, horizontal plane) is attached to the upper swing structure 12. The angle sensors 30, 31, and 32 can be each replaced by an angle sensor with respect to a reference plane (for example, horizontal plane).

<Drive System>

Figure 2:
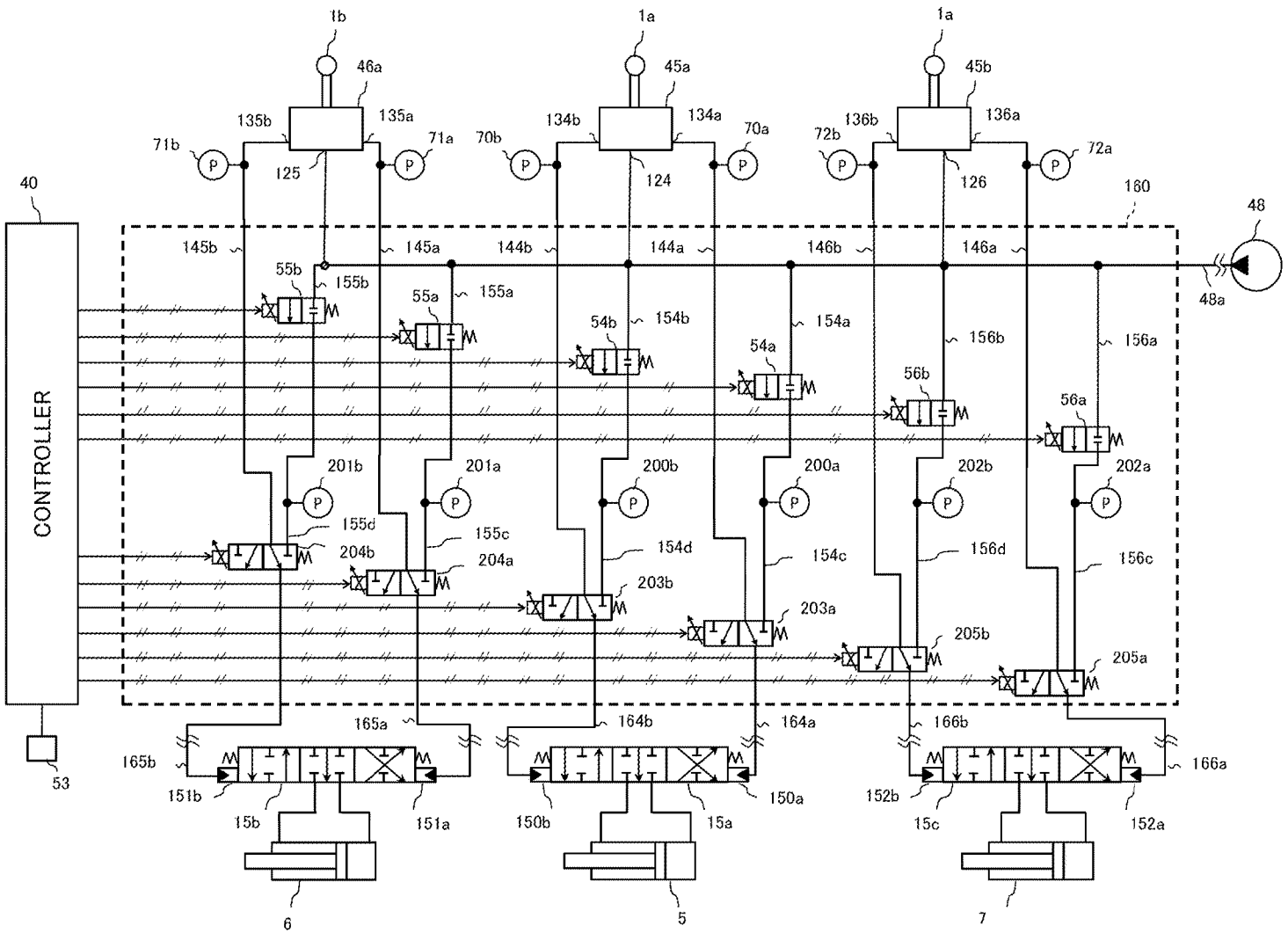
FIG. 2 is a diagram illustrating a front device control part of a drive system included in the work machine (hydraulic excavator) of the first embodiment of the present invention.

FIG. 2 is a diagram illustrating a front device control part of a drive system included in the work machine (hydraulic excavator) of the first embodiment of the present invention.

In FIG. 2, the drive system includes an operation device 45*a* for the boom, an operation device 46*a* for the arm, and an operation device 45*b* for the bucket. The operation device 45*a* for the boom and the operation device 45*b* for the bucket are operation devices operated by one operation lever 1*a* disposed on the right side of an operation seat 24 illustrated in FIG. 1. The operation device 46*a* for the arm is an operation device operated together with an operation device 46*b* for swing (see FIG. 3) by one operation lever 1*b* disposed on the left side of the operation seat 24 illustrated in FIG. 1.

Figure 3:
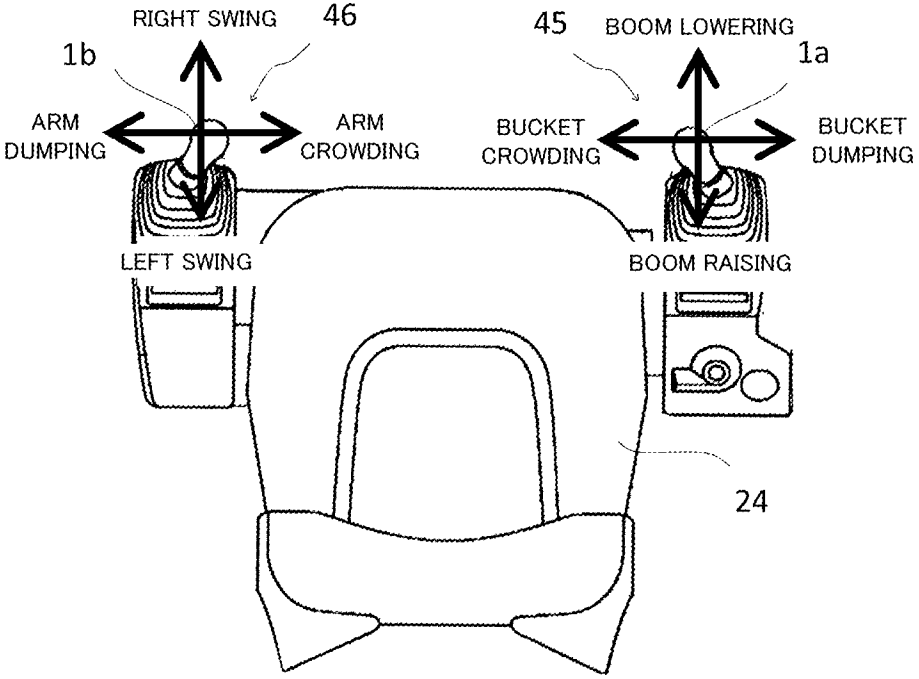
FIG. 3 is a diagram illustrating the arrangement and the operation form of an operation device for a boom, an operation device for an arm, and an operation device for a bucket.

FIG. 3 is a diagram illustrating the arrangement and the operation form of the operation device 45*a* for the boom, the operation device 46*a* for the arm, and the operation device 45*b* for the bucket.

The operation devices 45*a* and 45*b* are set on the right side of the front part of the operation seat 24 in an operation room (cabin) 23 of the hydraulic excavator illustrated in FIG. 1 and the operation device 46*a* is set on the left side of the front part of the operation seat 24. The operation devices 45*a* and 45*b* are configured as one operation lever unit 45 including the operation lever 1*a*. The operation device 46*a* is configured as one operation lever unit 46 including the operation lever 1*b* together with the operation device 46*b* for swing. An operator operates the right operation lever 1*a* with the right hand and operates the left operation lever 1*b* with the left hand.

The operation lever units 45 and 46 can each instruct operation of two hydraulic actuators by one operation lever 1*a* or 1*b*. The operation levers 1*a* and 1*b* can be each operated in an optional direction on the basis of the four directions of a cross. Operation of the operation lever 1*a* in the upward-downward direction in the diagrammatic representation corresponds to an operation instruction of the boom cylinder 5. Operation of the operation lever 1*a* in the left-right direction in the diagrammatic representation corresponds to an operation instruction of the bucket cylinder 7. Operation of the operation lever 1*b* in the left-right direction in the diagrammatic representation corresponds to an operation instruction of the arm cylinder 6. Operation of the operation lever 1*b* in the upward-downward direction in the diagrammatic representation corresponds to an operation instruction of the swing hydraulic motor 4 (see FIG. 1). Furthermore, operation of the operation lever 1*a* in the downward direction in the diagrammatic representation corresponds to an instruction of operation of the boom cylinder 5 in the extension direction (boom raising). Operation of the operation lever 1*a* in the upward direction in the diagrammatic representation corresponds to an instruction of operation of the boom cylinder 5 in the contraction direction (boom lowering). Operation of the operation lever 1*a* in the left direction in the diagrammatic representation corresponds to an instruction of operation of the bucket cylinder 7 in the extension direction (bucket crowding). Operation of the operation lever 1*a* in the right direction in the diagrammatic representation corresponds to an instruction of operation of the bucket cylinder 7 in the contraction direction (bucket dumping). Operation of the operation lever 1*b* in the right direction in the diagrammatic representation corresponds to an instruction of operation of the arm cylinder 6 in the extension direction (arm crowding). Operation of the operation lever 1*b* in the left direction in the diagrammatic representation corresponds to an instruction of operation of the arm cylinder 6 in the contraction direction (arm dumping).

Referring back to FIG. 2, the drive system includes a flow control valve 15*a* for the boom, a flow control valve 15*b* for the arm, and a flow control valve 15*c* for the bucket. The flow rate and the supply direction of a hydraulic fluid supplied from a main pump that is not illustrated in the diagram to the boom cylinder 5, the arm cylinder 6, and the bucket cylinder 7 are controlled by the flow control valve 15*a*, the flow control valve 15*b*, and the flow control valve 15*c*.

For the operation device 45*a* for the boom, the operation device 46*a* for the arm, and the operation device 45*b* for the bucket, primary ports (input ports) 124, 125, and 126 are connected to a pump line 48*a* of a pilot pump 48. The operation device 45*a* for the boom, the operation device 46*a* for the arm, and the operation device 45*b* for the bucket use the pressure of the pump line 48*a* as a primary pressure to generate an operation pilot pressure (secondary pressure) according to the operation amount of the operation lever 1*a* or 1*b*, and output the generated operation pilot pressure from secondary ports (output ports) 134*a*, 134*b*, 135*a*, 135*b*, 136*a*, and 136*b* to operation pilot lines 144*a*, 144*b*, 145*a*, 145*b*, 146*a*, and 146*b*.

The operation device 45*a* for the boom, when the operation lever 1*a* is operated in the right direction in FIG. 2 (downward direction in FIG. 3), generates the operation pilot pressure to drive the boom 8 in the raising direction and outputs the operation pilot pressure to the operation pilot line 144*a*. Furthermore, the operation device 45*a* for the boom, when the operation lever 1*a* is operated in the left direction in FIG. 2 (upward direction in FIG. 3), generates the operation pilot pressure to drive the boom 8 in the lowering direction and outputs the operation pilot pressure to the operation pilot line 144*b*. The operation device 46*a* for the arm, when the operation lever 1*b* is operated in the right direction in FIG. 2 (right direction in FIG. 3), generates the operation pilot pressure to drive the arm 9 in the crowding direction and outputs the operation pilot pressure to the operation pilot line 145*a*. Furthermore, the operation device 46*a* for the arm, when the operation lever 1*b* is operated in the left direction in FIG. 2 (left direction in FIG. 3), generates the operation pilot pressure to drive the arm 9 in the dumping direction and outputs the operation pilot pressure to the operation pilot line 145*b*. The operation device 45*b* for the bucket, when the operation lever 1*a* is operated in the right direction in FIG. 2 (left direction in FIG. 3), generates the operation pilot pressure to drive the bucket 10 in the crowding direction and outputs the operation pilot pressure to the operation pilot line 146*a*. Furthermore, the operation device 45*b* for the bucket, when the operation lever 1*a* is operated in the left direction in FIG. 2 (right direction in FIG. 3), generates the operation pilot pressure to drive the bucket 10 in the dumping direction and outputs the operation pilot pressure to the operation pilot line 146*b*.

Moreover, the drive system includes pressure sensors (operation pressure sensors) 70*a* and 70*b* that are disposed on the operation pilot lines 144*a* and 144*b* of the operation device 45*a* for the boom and sense the operation pilot pressure generated by the operation device 45*a* and proportional solenoid valves 54*a* and 54*b* that have the primary port connected to the pump line 48*a* through control pilot lines 154*a* and 154*b* and reduce the pilot pressure from the pump line 48*a* to generate a control pilot pressure. The drive system includes also pressure sensors (control pressure sensors) 200*a* and 200*b* that are connected to control pilot lines 154*c* and 154*d* on the secondary port side of the proportional solenoid valves 54*a* and 54*b* and sense the control pilot pressure generated by the proportional solenoid valves 54*a* and 54*b* and selector valves 203*a* and 203*b* connected to the operation pilot lines 144*a* and 144*b* on the secondary port side of the operation device 45*a* for the boom and the control pilot lines 154*c* and 154*d* on the secondary port side of the proportional solenoid valves 54*a* and 54*b*.

Drive pilot pressure input lines 164*a* and 164*b* are connected to hydraulic drive parts 150*a* and 150*b* of the flow control valve 15*a* for the boom. The selector valves 203*a* and 203*b* carry out switching about to which of the operation pilot line 144*a* or 144*b* and the control pilot line 154*c* or 154*d* the drive pilot pressure input line 164*a* or 164*b* is connected, on the basis of a control signal from a controller 40.

Furthermore, the drive system, also for the operation device 46*a* for the arm, similarly includes pressure sensors 71*a* and 71*b*, control pilot lines 155*a* and 155*b*, proportional solenoid valves 55*a* and 55*b*, control pilot lines 155*c* and 155*d*, pressure sensors 201*a* and 201*b*, drive pilot pressure input lines 165*a* and 165*b*, and selector valves 204*a* and 204*b*. Also for the operation device 45*b* for the bucket, similarly, the drive system includes pressure sensors 72*a* and 72*b*, control pilot lines 156*a* and 156*b*, proportional solenoid valves 56*a* and 56*b*, control pilot lines 156*c* and 156*d*, pressure sensors 202*a* and 202*b*, drive pilot pressure input lines 166*a* and 166*b*, and selector valves 205*a* and 205*b*.

In FIG. 2, connection lines between the pressure sensors 70*a* to 72*b* and the pressure sensors 200*a* to 202*b* and the controller 40 are omitted for simplification of the diagrammatic representation.

In the proportional solenoid valves 54*a* to 56*b*, the degree of opening is zero at the time of non-energization. The proportional solenoid valves 54*a* to 56*b* have a predetermined degree of opening at the time of energization and the degree of opening becomes higher as a current (control signal) from the controller 40 is increased. As above, the degree of opening of the proportional solenoid valves 54*a* to 56*b* becomes what depends on the control signal from the controller 40 and the proportional solenoid valves 54*a* to 56*b* reduce the pilot pressure from the pump line 48*a* according to the degree of opening to generate the control pilot pressure.

The selector valves 203*a* to 205*b* have a first position to form a circuit that connects the secondary port side of the operation device 45*a*, 45*b*, or 46*b* to the hydraulic drive section 150*a* to 152*b* of the flow control valve 15*a*, 15*b*, or 15*c* and a second position to form a circuit that connects the secondary port side of the proportional solenoid valve 54*a* to 56*b* to the hydraulic drive section 150*a* to 152*b* of the flow control valve 15*a*, 15*b*, or 15*c*. The selector valves 203*a* to 205*b* are switched to either position of the first position and the second position according to the control signal from the controller 40 to carry out switching of the circuit. The selector valves 203*a* to 205 are switched to the first position at the time of non-energization when the MC is not carried out, and are switched to the second position at the time of energization when the MC is carried out.

In the drive system configured as above, when the control signal is output from the controller 40 and the proportional solenoid valve 54*a* to 56*b* and the selector valve 203*a* to 205*b* are driven, the control pilot pressure is generated by the proportional solenoid valve 54*a* to 56*b* also in the case in which operator operation to the operation device 45*a*, 45*b*, or 46*a* is not made, and boom raising operation, boom lowering operation, arm crowding operation, arm dumping operation, bucket crowding operation, or bucket dumping operation can be forcibly caused by introducing the control pilot pressure to the hydraulic drive section 150*a* to 152*b* of the flow control valve 15*a*, 15*b*, or 15*c*. Furthermore, similarly to this, when an operator is operating the operation device 45*a*, 45*b*, or 46*a*, the velocity of boom raising operation, boom lowering operation, arm crowding operation, arm dumping operation, bucket crowding operation, or bucket dumping operation can be forcibly reduced from the value of the operator operation by generating the control pilot pressure by the proportional solenoid valve 54*a* to 56*b* and introducing the control pilot pressure to the hydraulic drive section 150*a* to 152*b* of the flow control valve 15*a*, 15*b*, or 15*c*. Moreover, when the selector valve 203*a* to 205*b* exists at the first position, the operation pilot pressure generated by the operation device 45*a*, 45*b*, or 46*a* is introduced to the hydraulic drive section 150*a* to 152*b* of the flow control valve 15*a*, 15*b*, or 15*c* without passing through the proportional solenoid valve 54*a* to 56*b*. Therefore, pressure loss as in the conventional case in which the operation pilot pressure passes through the proportional solenoid valve does not occur. Thus, the responsiveness of the hydraulic actuators 5, 6, and 7 to operation of the operation devices 45*a*, 46*a*, and 45*b* can be improved and operability equivalent to that of a work machine that does not have MC functions can be ensured.

Here, there is application to horizontal excavation as an MC function of the work machine. In this case, when an excavation operation signal (specifically, instruction of at least one of arm crowding, bucket crowding, and bucket dumping) is input through the operation devices 45*b* and 46*a*, on the basis of the positional relation between a target surface 60 (see FIG. 8) and a control point of the work device 1A, for example, the tip of the bucket 10 (in the present embodiment, claw tip of the bucket 10), a control signal that causes at least one of the hydraulic actuators 5, 6, and 7 to be forcibly operated (for example, causes the boom cylinder 5 to extend to forcibly carry out boom raising operation) in such a manner that the position of the control point of the work device 1A is kept on the target surface 60 and in a region on the upper side thereof is output to the corresponding flow control valve 15*a*, 15*b*, or 15*c*. The claw tip of the bucket 10 is prevented from entering the lower side of the target surface 60 by this MC function. Therefore, excavation along the target surface 60 is enabled irrespective of the degree of skill of the operator. In the present embodiment, the control point of the front work device 1A at the time of the MC is set to the claw tip of the bucket 10 of the hydraulic excavator (tip of the work device 1A). However, the control point can be changed also to a point other than the bucket claw tip as long as it is a point on the tip part of the work device 1A. For example, the bottom surface of the bucket 10 and the outermost part of the bucket link 13 can also be selected.

<Controller 40>

Figure 4:
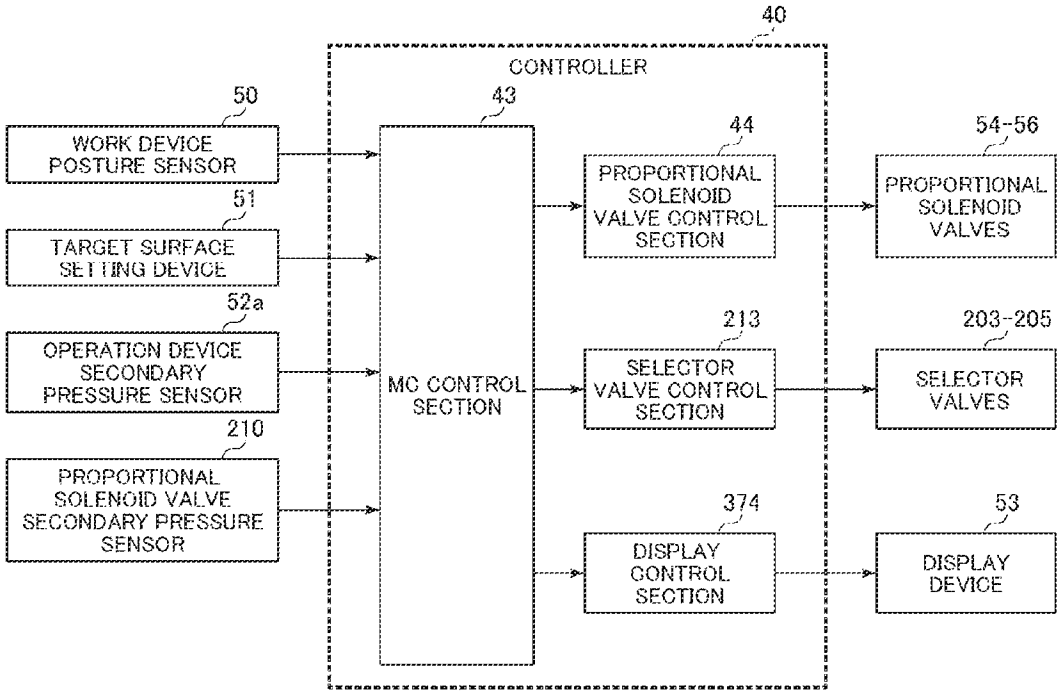
FIG. 4 is a functional block diagram of a controller.

FIG. 4 is a functional block diagram of the controller 40.

The controller 40 has an MC control section 43, a proportional solenoid valve control section 44, a selector valve control section 213, and a display control section 374.

The MC control section 43 inputs signals from a work device posture sensor 50, a target surface setting device 51, an operation device secondary pressure sensor 52*a*, and a proportional solenoid valve secondary pressure sensor 210 and carries out predetermined calculation on the basis of these signals to send calculation information to the proportional solenoid valve control section 44, the selector valve control section 213, and the display control section 374. The proportional solenoid valve control section 44, the selector valve control section 213, and the display control section 374 output a control signal and display information to the proportional solenoid valves 54*a* to 56*b*, the selector valves 203*a* to 205*b*, and a display device 53 on the basis of the calculation information.

The work device posture sensor 50 is composed of the boom angle sensor 30, the arm angle sensor 31, the bucket angle sensor 32, and the machine body inclination angle sensor 33. These sensors 30, 31, 32, and 33 function as a posture sensor of the work device 1A.

The target surface setting device 51 is an interface with which information relating to the target surface 60 (see FIG. 8) (including position information and inclination angle information of each target surface) can be input. The target surface setting device 51 is connected to an external terminal (not illustrated) in which three-dimensional data of target surfaces defined on the global coordinate system (absolute coordinate system) is stored. The input of the target surface through the target surface setting device 51 may be manually carried out by the operator.

The operation device secondary pressure sensor 52*a* is composed of the pressure sensors 70*a* to 72*b* that sense the operation pilot pressure generated in the operation pilot lines 144*a*, 144*b*, 145*a*, 145*b*, 146*a*, and 146*b* through operation of the operation levers 1*a* and 1*b* (operation devices 45*a*, 45*b*, and 46*a*).

The proportional solenoid valve secondary pressure sensor 210 is composed of the pressure sensors 200*a* to 202*b* that sense the control pilot pressure generated in the control pilot lines 154*c*, 154*d*, 155*c*, 155*d*, 156*c*, and 156*d* on the secondary port side of the proportional solenoid valves 54*a* to 56*b*.

Figure 5:
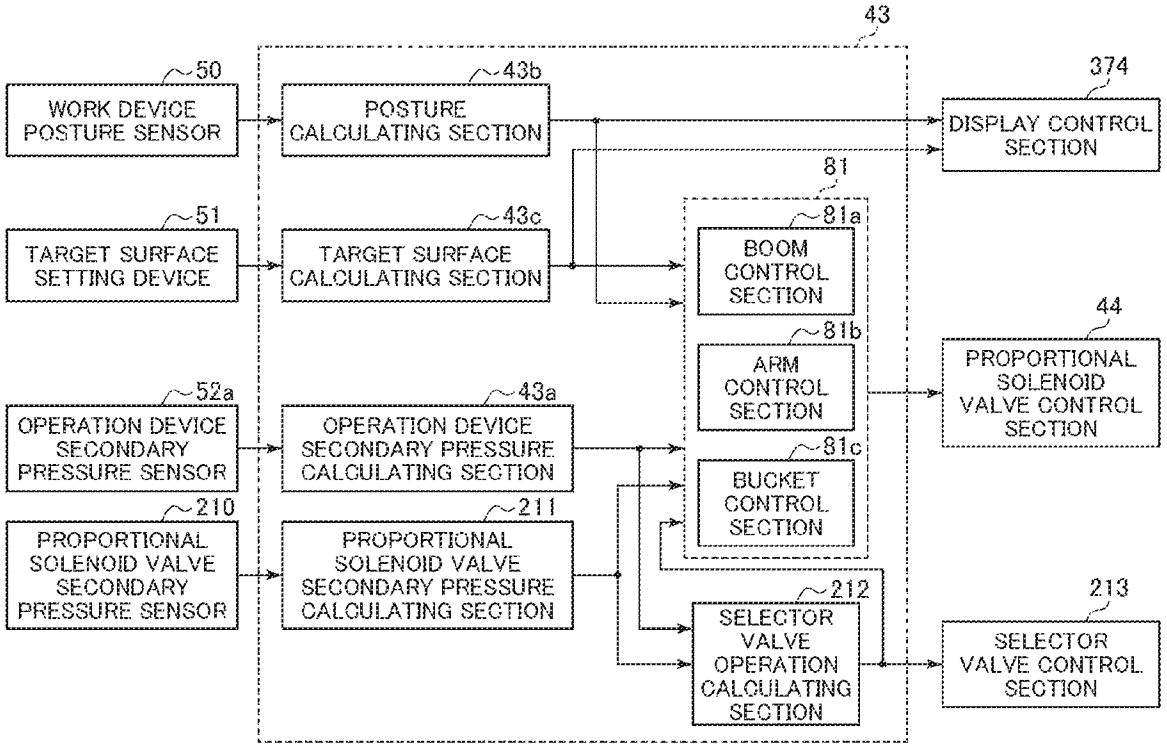
FIG. 5 is a functional block diagram of an MC control section illustrated in FIG. 4.

FIG. 5 is a functional block diagram of the MC control section 43 illustrated in FIG. 4.

The MC control section 43 has an operation device secondary pressure calculating section 43*a*, a posture calculating section 43*b*, a target surface calculating section 43*c*, an actuator control section 81 including a boom control section 81*a*, an arm control section 81*b*, and a bucket control section 81*c*, a proportional solenoid valve secondary pressure calculating section 211, and a selector valve operation calculating section 212.

The operation device secondary pressure calculating section 43*a* computes the operation pilot pressures that are the pressures of the secondary port of the operation devices 45*a*, 45*b*, and 46*a* from sensed values of the operation device secondary pressure sensor 52*a* (pressure sensors 70*a* to 72*b*).

The posture calculating section 43*b* calculates the posture of the front work device 1A and the position of the claw tip of the bucket 10 in a local coordinate system (for example, machine body coordinate system set on the machine body 1B in FIG. 1) on the basis of sensed values from the work device posture sensor 50 (boom angle sensor 30, arm angle sensor 31, bucket angle sensor 32, and machine body inclination angle sensor 33).

The target surface calculating section 43*c* calculates position information of the target surface 60 (see FIG. 8) on the basis of information from the target surface setting device 51.

The proportional solenoid valve secondary pressure calculating section 211 computes the control pilot pressures that are the pressures of the secondary port side of the proportional solenoid valves 54*a* to 56*b* on the basis of sensed values from the proportional solenoid valve secondary pressure sensor 210 (pressure sensors 200*a* to 202*b*).

The actuator control section 81 (boom control section 81*a*, arm control section 81*b*, and bucket control section 81*c*), on the basis of the output of each the operation device secondary pressure calculating section 43*a*, the posture calculating section 43*b*, the target surface calculating section 43*c*, the proportional solenoid valve secondary pressure calculating section 211, and the selector valve operation calculating section 212, calculates the target pilot pressure of the flow control valve 15*a*, 15*b*, or 15*c* for the hydraulic actuator 5, 6, or 7, according to a condition defined in advance (for example, work mode of front device operation input by the operator) at the time of operation of the operation device 45*a*, 45*b*, or 46*a* and outputs the calculated target pilot pressure to the proportional solenoid valve control section 44.

Here, the boom control section 81*a* is a section for carrying out operation control of the boom 8 by the MC at the time of operation of the operation device 45*a*, 45*b*, or 46*a*. For example, when horizontal excavation and position adjustment of the claw tip of the bucket 10 (to be described later) are set in the controller 40 as the work mode, the boom control section 81*a*, at the time of operation of the operation device 45*a*, 45*b*, or 46*a*, carries out MC to control operation of the boom cylinder 5 (boom 8) in such a manner that the claw tip (control point) of the bucket 10 is located on the target surface 60 or on the upper side thereof, on the basis of the position of the target surface 60 (see FIG. 8), the posture of the front work device 1A and the position of the claw tip of the bucket 10, the operation amount of the operation device 45*a*, 45*b*, or 46*a*, the pressure of the secondary port side of the proportional solenoid valve 54*a* or 54*b*, and the switching position of the selector valve 203*a* or 203*b*. The boom control section 81*a* calculates the target pilot pressure (target value of the control pilot pressure) of the flow control valve 15*a* relating to the boom cylinder 5 for carrying out the MC.

The arm control section 81*b* is a section for carrying out operation control of the arm 9 by the MC at the time of operation of the operation device 45*a*, 45*b*, or 46*a*. The arm control section 81*b* calculates the target pilot pressure (target value of the control pilot pressure) of the flow control valve 15*b* relating to the arm cylinder 6 for carrying out the MC.

The bucket control section 81*c* is a section for carrying out bucket angle control by the MC at the time of operation of the operation device 45*a*, 45*b*, or 46*a*. The bucket control section 81*c* calculates the target pilot pressure (target value of the control pilot pressure) of the flow control valve 15*c* relating to the bucket cylinder 7 for carrying out the MC.

The proportional solenoid valve control section 44 calculates command values to the proportional solenoid valves 54*a* to 56*b* on the basis of the target pilot pressures of the respective flow control valves 15*a*, 15*b*, and 15*c* output from the actuator control section 81.

The selector valve operation calculating section 212 calculates the target switching position of the selector valves 203*a* to 205*b* according to a condition defined in advance (for example, work mode of front device operation) at the time of operation of the operation device 45*a*, 45*b*, or 46*a* on the basis of the output of the operation device secondary pressure calculating section 43*a* and the output of the proportional solenoid valve secondary pressure calculating section 211.

The selector valve control section 213 calculates command values to the selector valves 203*a* to 205*b* on the basis of the target switching position of the selector valves 203*a* to 205*b* output from the selector valve operation calculating section 212.

The display control section 374 controls the display device 53 on the basis of the work device posture and the target surface output from the posture calculating section 43*b* and the target surface calculating section 43*c*. In the display control section 374, a display ROM in which a large number of pieces of display-related data including image and icon of the work device 1A are stored is included. The display control section 374 reads out a predetermined program on the basis of a flag included in input information and carries out display control in the display device 53.

<Selector Valve Control Flow of Selector Valve Operation Calculating Section 212>

Figure 6:
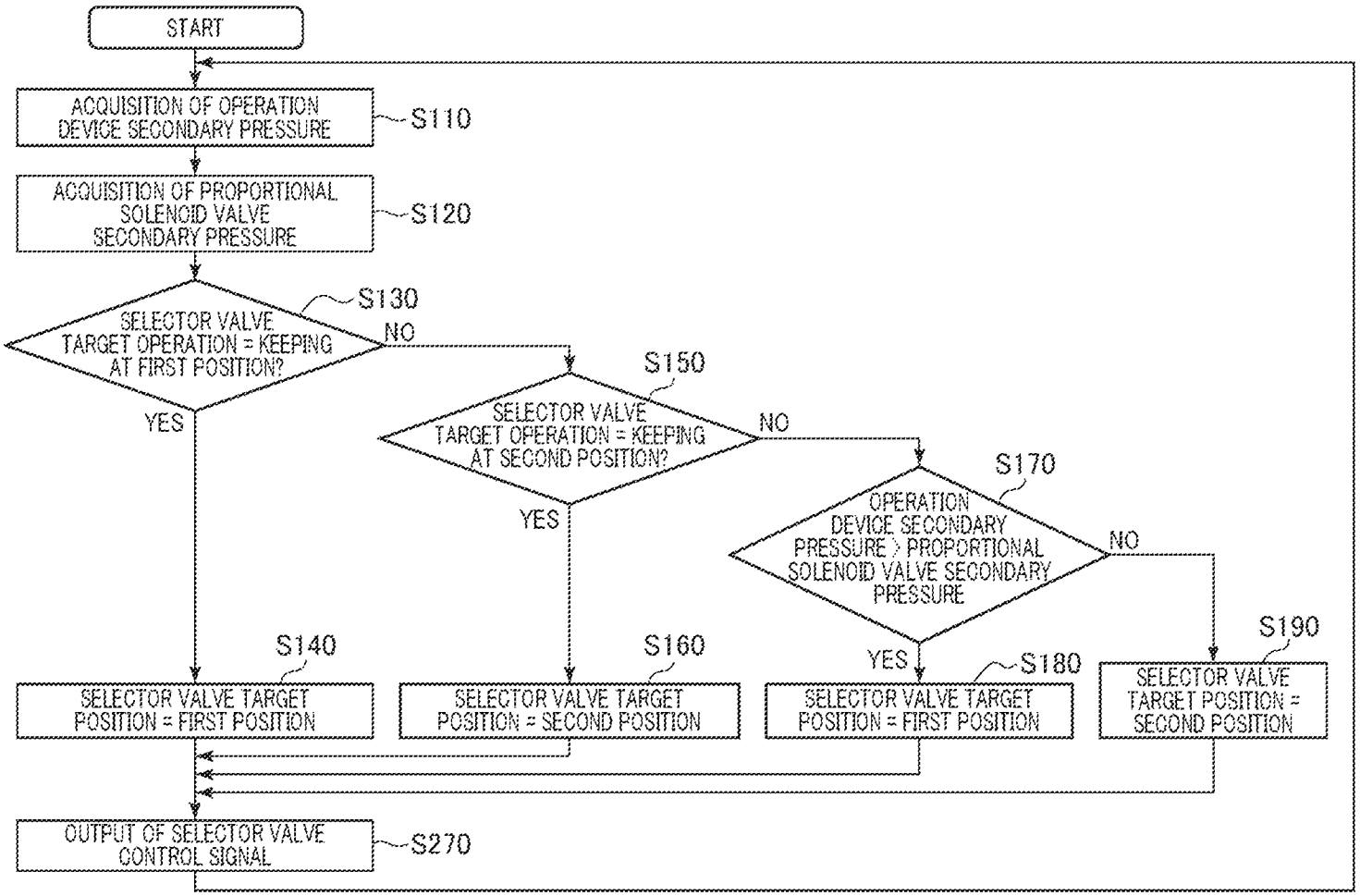
FIG. 6 is a diagram illustrating a control flow of selector valves in a selector valve operation calculating section illustrated in FIG. 5.

FIG. 6 is a diagram illustrating a control flow of the selector valves 203*a* to 205*b* in the selector valve operation calculating section 212 illustrated in FIG. 5. In the controller 40, with respect to the selector valves 203*a* to 205*b*, target operation for setting the target position according to a condition defined in advance (for example, work mode of front device operation) is set in advance.

In a step S110 in FIG. 6, the selector valve operation calculating section 212 acquires the operation pilot pressures that are the pressures of the secondary port side of the operation devices 45*a*, 45*b*, and 46*a* calculated in the operation device secondary pressure calculating section 43*a*.

In a step S120, the selector valve operation calculating section 212 acquires the control pilot pressures that are the pressures of the secondary port side of the proportional solenoid valves 54*a* to 56*b* calculated in the proportional solenoid valve secondary pressure calculating section 211.

In a step S130, the selector valve operation calculating section 212 determines whether or not the target operation set in advance regarding the selector valve 203*a* to 205*b* is keeping at the first position. When it is determined in the step S130 that the target operation is keeping at the first position, progress to a step S140 is made. When the target operation is other than keeping at the first position, progress to a step S150 is made.

In the step S140, the selector valve operation calculating section 212 sets the target position of the selector valve 203*a* to 205*b* to the first position.

In the step S150, the selector valve operation calculating section 212 determines whether or not the target operation set in advance regarding the selector valve 203*a* to 205*b* is keeping at the second position. When it is determined in the step S150 that the target operation is keeping at the second position, progress to a step S160 is made. When the target operation is other than keeping at the second position, progress to a step S170 is made.

In the step S160, the selector valve operation calculating section 212 sets the target position of the selector valve 203*a* to 205*b* to the second position.

In the step S170, the selector valve operation calculating section 212 compares the pressure of the secondary port side of the operation device 45*a*, 45*b*, or 46*a* with the pressure of the secondary port side of the corresponding proportional solenoid valve 54*a* to 56*b* acquired in the step S110 and the step S120, and determines whether or not the pressure of the secondary port side of the operation device 45*a*, 45*b*, or 46*a* is higher. When it is determined in the step S170 that the pressure of the secondary port side of the operation device 45*a*, 45*b*, or 46*a* is higher than the pressure of the secondary port side of the proportional solenoid valve 54*a* to 56*b*, progress to a step S180 is made. When it is determined that the pressure of the secondary port side of the operation device 45*a*, 45*b*, or 46*a* is equal to or lower than the pressure of the secondary port side of the proportional solenoid valve 54*a* to 56*b*, progress to a step S190 is made.

In the step S180, the selector valve operation calculating section 212 sets the target position of the selector valve 203*a* to 205*b* to the first position.

In the step S190, the selector valve operation calculating section 212 sets the target position of the selector valve 203*a* to 205*b* to the second position.

In a step S270, the selector valve operation calculating section 212 outputs the target position of the selector valve 203*a* to 205*b* to the selector valve control section 213.

The selector valve control section 213 calculates a command value to the selector valve 203*a* to 205*b* on the basis of the target position of the selector valve 203*a* to 205*b* and outputs a control signal to cause the position of the selector valve 203*a* to 205*b* to become the target position.

<Proportional Solenoid Valve Control Flow of Actuator Control Section 81>

Figure 7:
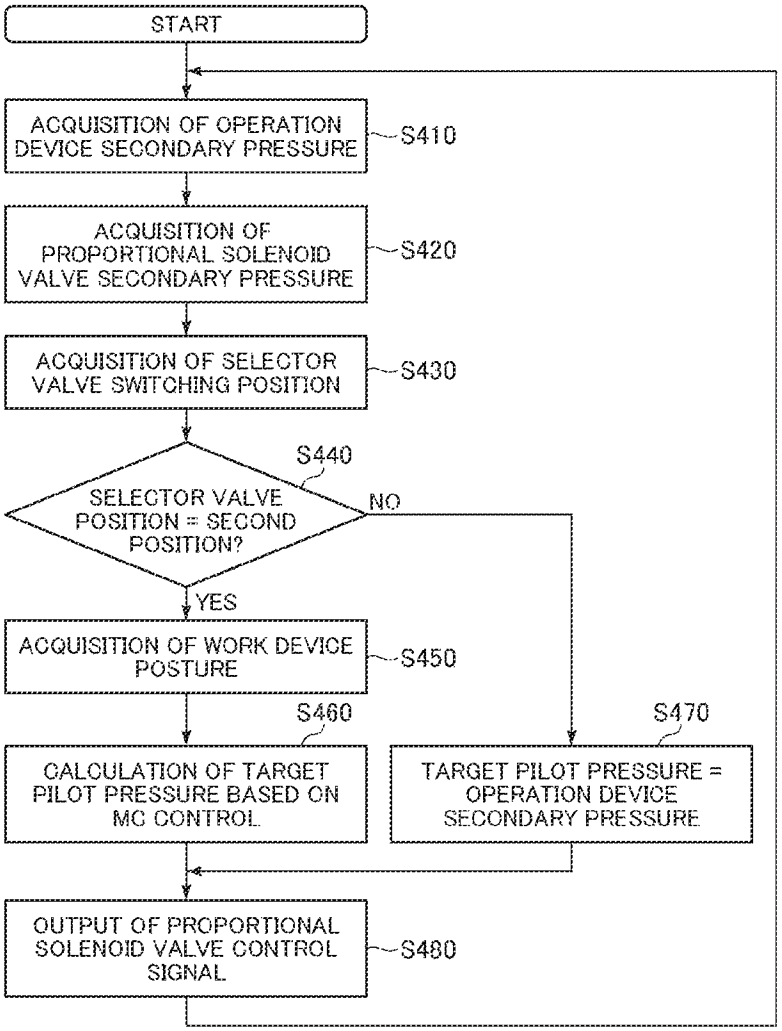
FIG. 7 is a diagram illustrating a control flow of proportional solenoid valves in an actuator control section (boom control section, arm control section, and bucket control section) illustrated in FIG. 5.

FIG. 7 is a diagram illustrating a control flow of the proportional solenoid valves 54*a* to 56*b* in the actuator control section 81 (boom control section 81*a*, arm control section 81*b*, and bucket control section 81*c*) illustrated in FIG. 5. In the controller 40, with respect to the proportional solenoid valves 54*a* to 56*b*, target operation for setting the target pilot pressure according to a condition defined in advance (for example, work mode of front device operation) is set in advance.

In a step S410, the actuator control section 81 acquires the operation pilot pressures that are the pressures of the secondary port side of the operation devices 45*a*, 45*b*, and 46*a* calculated in the operation device secondary pressure calculating section 43*a*.

In a step S420, the actuator control section 81 acquires the control pilot pressures that are the pressures of the secondary port side of the proportional solenoid valves 54*a* to 56*b* calculated in the proportional solenoid valve secondary pressure calculating section 211.

In a step S430, the actuator control section 81 acquires the target position of the selector valve 203*a* to 205*b* calculated in the selector valve operation calculating section 212.

In a step S440, the actuator control section 81 determines whether or not the position of the selector valve 203*a* to 205*b* is the second position. When it is determined in the step S440 that the position of the selector valve 203*a* to 205*b* is the second position, progress to a step S450 is made. When it is determined that the position of the selector valve 203*a* to 205*b* is other than the second position, i.e. the first position, progress to a step S470 is made.

In the step S450, the actuator control section 81 acquires the posture of the boom 8, the arm 9, and the bucket 10 calculated in the posture calculating section 43*b*.

In a step S460, the actuator control section 81, on the basis of the target operation set in advance, calculates and sets the target pilot pressure of the flow control valve 15*a*, 15*b*, or 15*c* that should be generated by the proportional solenoid valve 54*a* to 56*b* and is based on the MC.

In the step S470, the actuator control section 81, on the basis of the pressures of the secondary port side of the operation devices 45*a*, 45*b*, and 46*a* (operation pilot pressures) acquired in the step S410, sets the target pilot pressure equal to these operation pilot pressures.

In the step S480, the actuator control section 81 outputs the target pilot pressure for the flow control valve 15*a*, 15*b*, or 15*c* of the hydraulic actuator 5, 6, or 7 to the proportional solenoid valve control section 44.

The proportional solenoid valve control section 44 controls the proportional solenoid valves 54*a* to 56*b* in such a manner that the control pilot pressure equal to the target pilot pressure acts on the flow control valves 15*a*, 15*b*, and 15*c* relating to the hydraulic actuators 5, 6, and 7. Due to this, for example, even when an operator is carrying out boom lowering operation through operating the operation device 45*a*, operation of the boom 8 can be limited by generating the control pilot pressure in such a manner that the claw tip of the bucket 10 does not enter the target surface 60. Furthermore, in the case in which boom lowering operation needs to be carried out in order to cause the claw tip of the bucket 10 to operate along the target surface 60 in horizontal excavation or the like, generating the control pilot pressure allows the boom lowering operation to be automatically carried out without operation of the operation device 45*a* by the operator.

<Setting of Target Operation of Selector Valves and Proportional Solenoid Valves>

In the following, a setting example of the target operation of the selector valves and the proportional solenoid valves will be described by taking as an example the case in which horizontal excavation and position adjustment of the bucket claw tip are set as the work mode.

Figure 8:
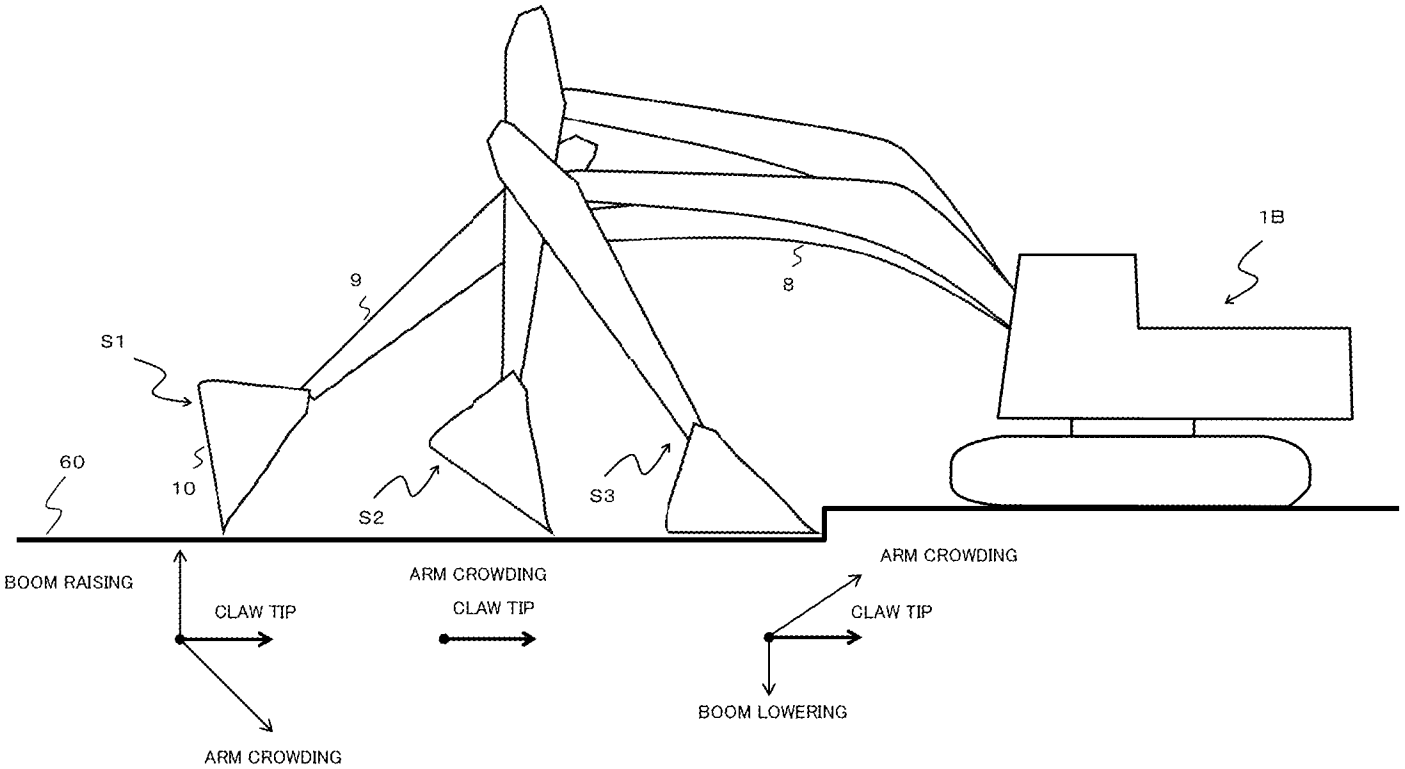
FIG. 8 is a diagram illustrating operation of horizontal excavation at the time of the MC and an image of synthesis of velocity vectors based on operation of the boom and the arm in the hydraulic excavator.

FIG. 8 is a diagram illustrating operation of the horizontal excavation at the time of the MC and an image of synthesis of velocity vectors based on operation of the boom 8 and the arm 9 in the hydraulic excavator configured as above.

In the horizontal excavation, the front work device 1A makes transitions from a state S1 (FIG. 8: excavation start posture) to a state S2 (FIG. 8: arm vertical posture) and to a state S3 (FIG. 8: excavation end posture).

Figure 9:
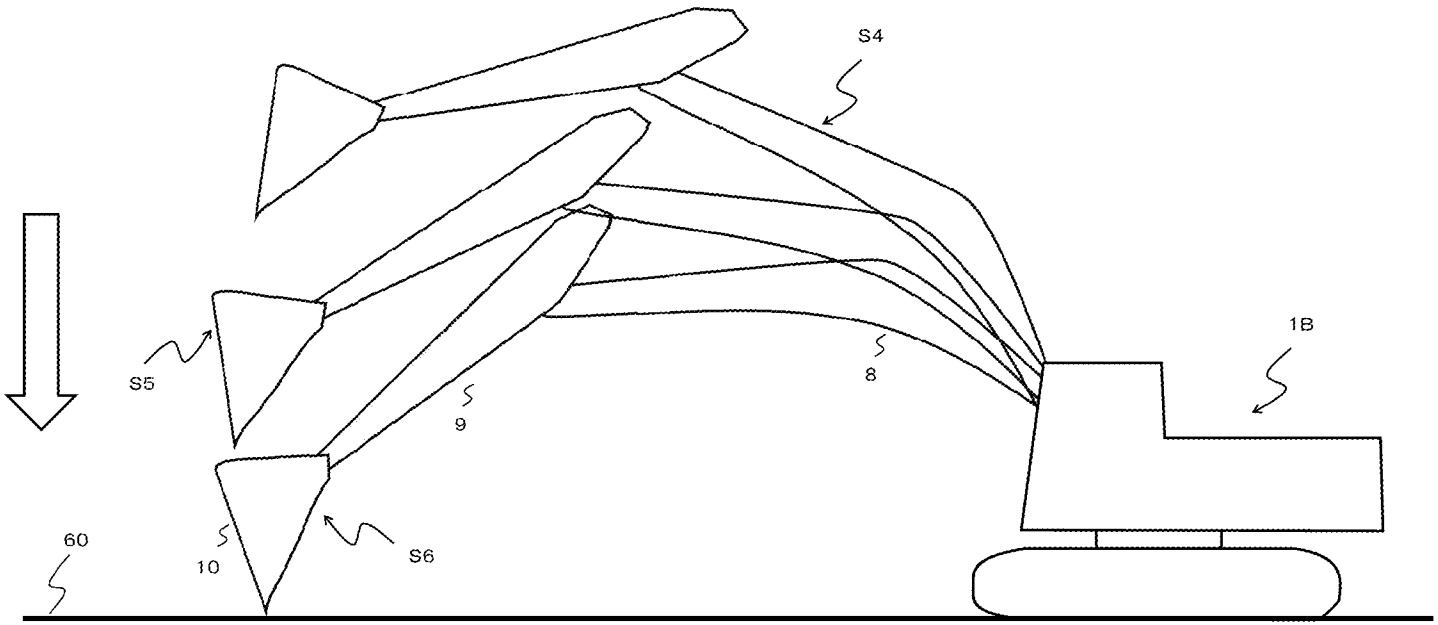
FIG. 9 is a diagram illustrating operation of position adjustment of the claw tip of the bucket to a target surface at the time of the MC in the hydraulic excavator.

FIG. 9 is a diagram illustrating operation of position adjustment of the claw tip of the bucket 10 to the target surface 60 at the time of the MC.

In the position adjustment of the claw tip of the bucket 10, the front work device 1A makes transitions from a state S4 (FIG. 9: height of the claw tip of the bucket 10 is high) to a state S5 (FIG. 9: height of the claw tip of the bucket 10 is middle) and to a state S6 (FIG. 9: height of the claw tip of the bucket 10 is 0).

The controller 40, in the horizontal excavation illustrated in FIG. 8, carries out boom raising control and boom lowering control as the MC by combining control of the proportional solenoid valves 54*a* and 54*b* by the boom control section 81*a* and control of the selector valves 203*a* and 203*b* by the selector valve operation calculating section 212.

Furthermore, the controller 40, in the operation of the position adjustment of the claw tip of the bucket 10 illustrated in FIG. 9, carries out boom lowering control as the MC by combining control of the proportional solenoid valve 54*b* by the boom control section 81*a* and control of the selector valve 203*b* by the selector valve operation calculating section 212.

Here, when the horizontal excavation and the position adjustment of the bucket claw tip based on the MC are carried out, the work mode of the horizontal excavation and the position adjustment of the bucket claw tip is set in the controller 40 through operation by the operator and the target operation of the selector valves 203*a* to 205*b* and the proportional solenoid valves 54*a* to 56*b* is set in the controller 40 in advance on the basis of the work mode.

The target operation set in advance regarding the selector valves 203*a* to 205*b* includes first target operation of keeping each selector valve at the first position, second target operation of keeping each selector valve at the second position, and third target operation of switching each selector valve to either the first position or the second position to introduce, to the corresponding flow control valve, the higher pressure of the operation pilot pressure sensed by the pressure sensor 70*a* to 72*b* and the control pilot pressure sensed by the pressure sensor 200*a* to 202*b* (hereinafter, referred to as "switching to the higher-pressure selection position").

The target operation set in advance regarding the proportional solenoid valves 54*a* to 56*b* includes first target operation of generating the target pilot pressure to equalize the control pilot pressure sensed by the pressure sensor 200*a* to 202*b* to the operation pilot pressure sensed by the pressure sensor 70*a* to 72*b* when the selector valve 203*a* to 205*b* exists at the first position, and second target operation of generating the target pilot pressure based on the MC when the selector valve 203*a* to 205*b* exists at the second position.

The selector valve operation calculating section 212 of the controller 40 sets the target position of the selector valves 203*a* to 205*b* to either the first position or the second position on the basis of the above-described target operation set in advance.

The actuator control section 81 of the controller 40 calculates and sets the target pilot pressures of the proportional solenoid valves 54*a* to 56*b* on the basis of the above-described target operation set in advance.

When the work mode input and set to the controller 40 by the operator is the horizontal excavation illustrated in FIG. 8 and the position adjustment of the claw tip of the bucket 10 illustrated in FIG. 9, the target operation set for the selector valves 203*a* to 205*b* is as follows.

1. Selector valves 204*a*, 204*b*, 205*a*, 205*b*
   Keeping at the first position (first target operation)
2. Selector valve 203*b*
   Keeping at the second position (second target operation)
3. Selector valve 203*a*
   Switching to the higher-pressure selection position (third target operation)

The controller 40 allows setting of a desired work mode through operation by the operator besides the horizontal excavation illustrated in FIG. 8 and the position adjustment of the claw tip of the bucket 10 illustrated in FIG. 9. Furthermore, any of the above-described first target operation, second target operation, and third target operation is set in the selector valves 203*a* to 205*b* according to the work mode.

Summarization of Characteristics of Present Embodiment

As above, in the work machine of the present embodiment, the drive system includes the selector valve 203*a* (first selector valve) disposed between the secondary port 134*a* (first output port) of the operation device 45*a* (first operation device) and the flow control valve 15*a* (first flow control valve) and between the proportional solenoid valve 54*a* (first proportional solenoid valve) and the flow control valve 15*a* and the selector valve 203*b* (second selector valve) disposed between the secondary port 134*b* (second output port) of the operation device 45*a* and the flow control valve 15*a* and between the proportional solenoid valve 54*b* (second proportional solenoid valve) and the flow control valve 15*a*.

Furthermore, the selector valve 203*a* (first selector valve) has the first position to interrupt the connection between the proportional solenoid valve 54*a* (first proportional solenoid valve) and the flow control valve 15*a* and connect the secondary port 134*a* (first output port) of the operation device 45*a* (first operation device) to the flow control valve 15*a* and the second position to interrupt the connection between the secondary port 134*a* of the operation device 45*a* and the flow control valve 15*a* and connect the proportional solenoid valve 54*a* to the flow control valve 15*a*. The selector valve 203*b* (second selector valve) has the first position to interrupt the connection between the proportional solenoid valve 54*b* (second proportional solenoid valve) and the flow control valve 15*a* and connect the secondary port 134*b* (second output port) of the operation device 45*a* to the flow control valve 15*a* and the second position to interrupt the connection between the secondary port 134*b* of the operation device 45*a* and the flow control valve 15*a* and connect the proportional solenoid valve 54*b* to the flow control valve 15*a*.

The controller 40 is configured to switch the selector valves 203*a* and 203*b* to either one of the first position and the second position on the basis of signals from the pressure sensors 70*a* and 70*b* (first and second operation pressure sensors) and the pressure sensors 200*a* and 200*b* (first and second control pressure sensors) and the target operation set in advance regarding the selector valves 203*a* and 203*b* (first and second selector valves).

Furthermore, the controller 40 is configured to, as the target operation set in advance regarding the selector valves 203*a* and 203*b* (first and second selector valves), set one of the first target operation of keeping at the first position, the second target operation of keeping at the second position, and the third target operation of switching to one of the first position and the second position to introduce, to the flow control valve 15*a*, the higher pressure of the operation pilot pressure (first operation pilot pressure) output from the secondary port 134*a* (first output port) of the operation device 45*a* (first operation device) and the control pilot pressure (first control pilot pressure) generated by the proportional solenoid valve 54*a* (first proportional solenoid valve) and the higher pressure of the operation pilot pressure (second operation pilot pressure) output from the secondary port 134*b* (second output port) of the operation device 45*a* and the control pilot pressure (second control pilot pressure) generated by the proportional solenoid valve 54*b* (second proportional solenoid valve). In addition, the controller 40 sets the target position of the selector valves 203*a* and 203*b* on the basis of this set target operation to switch the selector valves 203*a* and 203*b* to either one of the first position and the second position.

Moreover, the controller 40 is configured to, as the target operation of the proportional solenoid valves 54*a* and 54*b* (first and second proportional solenoid valves), set the first target operation of equalizing the control pilot pressures (first and second control pilot pressures) sensed by the pressure sensors 200*a* and 200*b* (first and second control pressure sensors) to the operation pilot pressures (first and second operation pilot pressures) sensed by the pressure sensors 70*a* and 70*b* (first and second operation pressure sensors), respectively, when the selector valves 203*a* and 203*b* (first and second selector valves) exist at the first position, and set the second target operation on the basis of automatic control in advance when the selector valves 203*a* and 203*b* exist at the second position. In addition, the controller 40 sets the target pilot pressure of the proportional solenoid valves 54*a* and 54*b* (first and second proportional solenoid valves) on the basis of the set target operation and controls the proportional solenoid valves 54*a* and 54*b*.

Furthermore, in the present embodiment, for each of the operation devices 45*a*, 46*a*, and 45*b* (plural operation devices), the pressure sensors 70*a* and 70*b* (first and second operation pressure sensors), the pressure sensors 71*a* and 71*b* (first and second operation pressure sensors), the pressure sensors 72*a* and 72*b* (first and second operation pressure sensors), the proportional solenoid valves 54*a* and 54*b* (first and second proportional solenoid valves), the proportional solenoid valves 55*a* and 55*b* (first and second proportional solenoid valves), the proportional solenoid valves 56*a* and 56*b* (first and second proportional solenoid valves), the pressure sensors 200*a* and 200*b* (first and second control pressure sensors), the pressure sensors 201*a* and 201*b* (first and second control pressure sensors), the pressure sensors 202*a* and 202*b* (first and second control pressure sensors), the selector valves 203*a* and 203*b* (first and second selector valves), the selector valves 204*a* and 204*b* (first and second selector valves), and the selector valves 205*a* and 205*b* (first and second selector valves) are disposed, and the controller 40 is configured to switch the selector valves 203*a* and 203*b*, the selector valves 204*a* and 204*b*, and the selector valves 205*a* and 205*b* to either one of the first position and the second position on the basis of signals from the pressure sensors 70*a* and 70*b*, the pressure sensors 71*a* and 71*b*, the pressure sensors 72*a* and 72*b*, the pressure sensors 200*a* and 200*b*, the pressure sensors 201*a* and 201*b*, and the pressure sensors 202*a* and 202*b* and the target operation set in advance regarding the selector valves 203*a* and 203*b*, the selector valves 204*a* and 204*b*, and the selector valves 205*a* and 205*b*.

The controller 40 is configured for each of the operation devices 45*a*, 46*a*, and 45*b* (plural operation devices) to set, as the target operation set in advance regarding the selector valves 203*a* and 203*b* (first and second selector valves), the selector valves 204*a* and 204*b* (first and second selector valves), and the selector valves 205*a* and 205*b* (first and second selector valves), one of the first target operation of keeping at the first position, the second target operation of keeping at the second position, and the third target operation of switching to one of the first position and the second position to introduce, to the flow control valves 15*a*, 15*b*, and 15*c* (plural flow control valves), the higher pressure of the operation pilot pressure (first operation pilot pressure) sensed by the pressure sensors 70*a*, 71*a*,72*a* and the control pilot pressure (first control pilot pressure) sensed by the pressure sensors 200*a*, 201*a*, 202*a* and the higher pressure of the operation pilot pressure (second operation pilot pressure) sensed by the pressure sensors 70*b*, 71*b*, 72*b* and the control pilot pressure (second control pilot pressure) sensed by the pressure sensors 200*b*, 201*b*, 202*b*. In addition, the controller 40 decides the target position of the selector valves 203*a* and 203*b*, the selector valves 204*a* and 204*b*, and the selector valves 205*a* and 205*b* on the basis of the set target operation to switch the selector valves 203*a* and 203*b*, the selector valves 204*a* and 204*b*, and the selector valves 205*a* and 205*b* to either one of the first position and the second position.

<Operation>

Next, description will be made about operator operation and operation of the controller 40 (actuator control section 81 and selector valve operation calculating section 212) in the case in which, in the horizontal excavation illustrated in FIG. 8, the front work device 1A makes transitions from the state S1 (FIG. 8: excavation start posture) to the state S2 (FIG. 8: arm vertical posture) and to the state S3 (FIG. 8: excavation end posture).

During the state from the state S1 to the state S3 in FIG. 8, the operator operates only the operation lever 1*b* and inputs arm crowding operation.

In the state S1 in FIG. 8, on the basis of the above-described third target operation (switching to the higher-pressure selection position) set in advance regarding the selector valve 203*a*, NO is determined in the step S130 in FIG. 6 regarding the selector valve 203*a* and NO is determined also in the step S150. Furthermore, NO is determined in the step S170 because the operator is not operating the operation device 45*a* and therefore the pressure of the secondary port side of the operation device 45*a* (operation pilot pressure) is 0. As a result, the target position of the selector valve 203*a* is set to the second position in the step S190 and control is carried out to set the selector valve 203*a* to the second position in the selector valve control section 213.

Moreover, since the position of the selector valve 203*a* is the second position, YES is determined in the step S440 in FIG. 7. Then, in the step S460, the target pilot pressure of raising operation of the boom 8 by the MC is calculated on the basis of the second target operation (generation of the target pilot pressure based on the MC) set in advance regarding the proportional solenoid valve 54*a*. Then, a command value to the proportional solenoid valve 54*a* is calculated in the proportional solenoid valve control section 44 on the basis of the target pilot pressure for the flow control valve 15*a*, and the proportional solenoid valve 54*a* is controlled. Due to this, raising operation of the boom 8 is automatically carried out by the MC in such a manner that the claw tip of the bucket 10 does not enter the target surface 60.

The above operation is carried out until a transition to the state S2 in FIG. 8 is made.

In the state S2 in FIG. 8, on the basis of the above-described third target operation (switching to the higher-pressure selection position) set in advance regarding the selector valve 203*a*, NO is determined in the step S130 in FIG. 6 regarding the selector valve 203*a* and NO is determined in the step S150. Then, NO is determined in the step S170 because the operator is not operating the operation device 45*a* and therefore the pressure of the secondary port side of the operation device 45*a* is 0. As a result, the target position of the selector valve 203*a* is set to the second position in the step S190 and control is carried out to set the selector valve 203*a* to the second position in the selector valve control section 213.

Moreover, since the position of the selector valve 203*a* is the second position, YES is determined in the step S440 in FIG. 7. Then, in the step S460, the target pilot pressure of boom raising operation by the MC is calculated on the basis of the second target operation set in advance regarding the proportional solenoid valve 54*a*. Then, a command value to the proportional solenoid valve 54*a* is calculated in the proportional solenoid valve control section 44 on the basis of the target pilot pressure for the flow control valve 15*a*, and the proportional solenoid valve 54*a* is controlled. However, in the state S2, the arm 9 operates almost horizontally and therefore the target pilot pressure of the boom raising operation calculated by the MC is almost 0.

After the state S2 in FIG. 8 and until the state S3, on the basis of the above-described second target operation (keeping at the second position) set in advance regarding the selector valve 203*b*, NO is determined in the step S130 in FIG. 6 regarding the selector valve 203*b* and YES is determined in the step S150. Then, the target position of the selector valve 203*b* is set to the second position in the step S160 and control is carried out to cause the selector valve 203*b* to be kept at the second position in the selector valve control section 213. Furthermore, since the position of the selector valve 203*b* is the second position, YES is determined in the step S440 in FIG. 7. Then, in the step S460, the target pilot pressure of boom lowering operation by the MC is calculated on the basis of the second target operation set in advance regarding the proportional solenoid valve 54*b*. Then, a command value to the proportional solenoid valve 54*b* is calculated in the proportional solenoid valve control section 44 on the basis of the target pilot pressure for the flow control valve 15*a*, and the proportional solenoid valve 54*b* is controlled. Due to this, lowering operation of the boom 8 is automatically carried out by the MC in such a manner that the claw tip of the bucket 10 does not get separated from the target surface 60.

Furthermore, during the state from the state S1 to the state S3 in FIG. 8, on the basis of the above-described third target operation (switching to the higher-pressure selection position) set in advance regarding the selector valve 203*a*, the selector valve 203*a* is set to introduce the higher pressure of the operation pilot pressure and the control pilot pressure to the hydraulic drive section 150*a* of the flow control valve 15*a*. Thus, when the operation lever 1*a* is operated and boom raising operation is input, YES is determined in the step S170 in FIG. 6. Then, the target position of the selector valve 203*a* is set to the first position in the step S180 and control is carried out to set the selector valve 203*a* to the first position in the selector valve control section 213. Due to the setting of the selector valve 203*a* to the first position, the operation pilot line 144*a* of the operation device 45*a* and the hydraulic drive section 150*a* of the flow control valve 15*a* are connected to each other and normal operation by the operator becomes valid for the boom raising operation. Due to this, even in MC operation, it is also possible to raise the boom 8 on the basis of operator's intention to separate the claw tip of the bucket 10 from the target surface 60 in the case in which the bucket 10 is filled up with earth and sand in the middle of excavation, or the like.

Furthermore, at this time, the pressure of the secondary port side of the operation device 45*a* (operation pilot pressure) is introduced to the hydraulic drive section 150*a* of the flow control valve 15*a* without passing through the proportional solenoid valve 54*a*. Thus, pressure loss as in the conventional case in which the operation pilot pressure passes through the proportional solenoid valve does not occur, thus the responsiveness of the hydraulic actuator 5 to operation of the operation device 45*a* can be improved and operability equivalent to that of a work machine that does not have MC functions can be ensured.

Moreover, during the state from the state S1 to the state S3 in FIG. 8, the selector valves 204*a*, 204*b*, 205*a*, and 205*b* are always controlled to the first position on the basis of the first target operation (keeping at the first potential) set in advance. Therefore, also when the operator operates the operation device 46*a* or 45*b*, the operation pilot pressure is introduced to the hydraulic drive section 151*a*, 151*b*, 152*a*, or 152*b* of the flow control valve 15*b* or 15*c* without passing through the proportional solenoid valve. Thus, also in this case, pressure loss as in the conventional case in which the operation pilot pressure passes through the proportional solenoid valve does not occur and operability equivalent to that of a machine that is not equipped with MC functions can be ensured regarding arm crowding operation, arm dumping operation, bucket crowding operation, and bucket dumping operation.

Next, description will be made about operator operation and operation of the controller 40 (actuator control section 81 and selector valve operation calculating section 212) in the case in which, in the operation of the position adjustment of the claw tip of the bucket 10 to the target surface 60 illustrated in FIG. 9, the front work device 1A makes transitions from the state S4 (FIG. 9: height of the claw tip of the bucket 10 is high) to the state S5 (FIG. 9: height of the claw tip of the bucket 10 is middle) and to the state S6 (FIG. 9: height of the claw tip of the bucket 10 is 0).

During the state from the state S4 to the state S6 in FIG. 9, the operator operates only the operation lever 1*a* and inputs boom lowering operation.

In the state S4 to the state S6 in FIG. 9, on the basis of the above-described second target operation (keeping at the second position) set in advance regarding the selector valve 203*b*, NO is determined in the step S130 in FIG. 6 regarding the selector valve 203*b* and YES is determined in the step S150. Then, the target position of the selector valve 203*b* is set to the second position in the step S160. Thus, control is carried out to set the selector valve 203*b* to the second position in the selector valve control section 213. Furthermore, since the position of the selector valve 203*b* is the second position, YES is determined in the step S440 in FIG. 7. Then, in the step S460, the target pilot pressure of lowering operation of the boom 8 by the MC is calculated on the basis of the second target operation set in advance regarding the proportional solenoid valve 54*b*. Then, a command value to the proportional solenoid valve 54*b* is calculated in the proportional solenoid valve control section 44 on the basis of the target pilot pressure for the flow control valve 15*a*, and the proportional solenoid valve 54*b* is controlled.

Here, in the state S4, the distance between the target surface 60 and the claw tip of the bucket 10 is long. Therefore, limitation of the boom lowering operation by the MC is not carried out, and the control pilot pressure equal to the operation pilot pressure of the boom lowering operation calculated in the operation device secondary pressure calculating section 43*a* is calculated as the target pilot pressure and the target pilot pressure is output from the boom control section 81*a*.

The above operation is carried out until a transition to the state S5 is made.

In the state S5, the distance between the target surface 60 and the claw tip of the bucket 10 is short and therefore limitation (velocity reduction) of the boom lowering operation is started in the MC in order to prevent entry into the target surface 60. In the boom control section 81*a*, a value obtained by reducing the operation pilot pressure of the boom lowering operation calculated in the operation device secondary pressure calculating section 43*a* is output as the target pilot pressure according to the distance between the target surface 60 and the claw tip of the bucket 10.

In the state S6, the claw tip of the bucket 10 has reached the target surface 60 and therefore limitation (stop) of the boom lowering operation is carried out in the MC in order to prevent entry into the target surface 60. In the boom control section 81*a*, 0 is output as the target pilot pressure.

Due to this, even when the operator operates the operation lever 1*a* to continue to input the boom lowering operation, the claw tip of the bucket 10 can be automatically stopped at the target surface 60 and the position adjustment can be carried out.

<Effects>

According to the present embodiment, the following effects are obtained.

1. As in the above-described operation example of the position adjustment of the bucket claw tip illustrated in FIG. 9, while the work device 1A is in the state S5 to S6, by switching the selector valve 203*b* to the second position and controlling the proportional solenoid valve 54*b* to generate the control pilot pressure obtained by reducing the operation pilot pressure sensed by the pressure sensor 70*b*, operation of the boom cylinder 5 in the boom lowering direction can be limited and it becomes possible to limit operation of the work device 1A by the MC. Also in the cases in which the selector valves 203*a*, 204*a*, 204*b*, 205*a*, and 205*b* are switched to the second position and the proportional solenoid valves 54*a*, 55*a*, 55*b*, 56*a*, and 56*b* are similarly controlled in other work modes, similarly it becomes possible to limit operation of the work device 1A by the MC.

2. When the work mode is not set and the MC is not carried out, all proportional solenoid valves 54*a* to 56*b* become non-excited and switching to the first position is carried out. Also in the case of carrying out normal work based on operator operation, the responsiveness of the hydraulic actuators 5, 6, and 7 to the operator operation can be improved and operability equivalent to that of a work machine that does not have MC functions can be ensured.

Furthermore, as in the above-described operation example of the horizontal excavation illustrated in FIG. 8, when the operator operates the first operation device in MC operation while the work device 1A is in the state S1 to S3, the operation pilot pressure output from the secondary port 134*a* of the operation device 45*a* is introduced to the flow control valve 15*a* without passing through the proportional solenoid valve 54*a* by switching the selector valve 203*a* to the first position. Thus, pressure loss as in the conventional case in which the operation pilot pressure passes through the proportional solenoid valve does not occur, thus the responsiveness of the boom cylinder 5 to operation of the operation device 45*a* by the operator can be improved and operability equivalent to that of a work machine that does not have MC functions can be ensured. Also in the cases in which the selector valves 203*b*, 204*a*, 204*b*, 205*a*, and 205*b* are switched to the first position when the operator operates the operation device in other work modes, similarly the responsiveness of the hydraulic actuators 5, 6, and 7 to the operation of the operation devices 45*a*, 46*a*, and 45*b* by the operator can be improved and operability equivalent to that of a work machine that does not have MC functions can be ensured.

Moreover, in the operation example of the horizontal excavation illustrated in FIG. 8 by the MC, during the state from the state S1 to the state S3 in FIG. 8, the selector valves 204*a*, 204*b*, 205*a*, and 205*b* are always controlled to the first position on the basis of the first target operation (keeping at the first position) set in advance. Thus, also when the operator operates the operation device 46*a*, 45*b*, the operation pilot pressure is introduced to the hydraulic drive section 151*a*, 151*b*, 152*a*, or 152*b* of the flow control valve 15*b* or 15*c* without passing through the proportional solenoid valve. Therefore, also in this case, pressure loss as in the conventional case in which the operation pilot pressure passes through the proportional solenoid valve does not occur and operability equivalent to that of a machine that is not equipped with MC functions can be ensured regarding arm crowding operation, arm dumping operation, bucket crowding operation, and bucket dumping operation.

3. As in the above-described operation example of the horizontal excavation illustrated in FIG. 8, the boom cylinder 5 can be automatically operated in the boom raising direction by switching the selector valve 203*a* to the second position and controlling the proportional solenoid valve 54*a* to generate the control pilot pressure based on the MC. In addition, the boom cylinder can be automatically operated in the boom lowering direction by switching the selector valve

203*b* to the second position and controlling the proportional solenoid valve 54*b* to generate the second control pilot pressure based on the MC. This makes it possible to cause the boom cylinder 5 that is the hydraulic actuator for which the operation device 45*a* is not being operated to automatically operate in either direction of the boom raising direction and the boom lowering direction. Also in the cases in which the selector valves 204*a*, 204*b*, 205*a*, and 205*b* for which the operation device is not being operated to the second position in other work modes, similarly the hydraulic actuators 5, 6, and 7 can be operated in either direction of the operation directions thereof.

Modification Example

In the first embodiment, for each of the operation devices 45*a*, 46*a*, and 45*b*, the pressure sensors 70*a* and 70*b*; 71*a* and 71*b*; and 72*a* and 72*b*, the proportional solenoid valves 54*a* and 54*b*; 55*a* and 55*b*; and 56*a* and 56*b*, the pressure sensors 200*a* and 200*b*; 201*a* and 201*b*; and 202*a* and 202*b*, and the selector valves 203*a* and 203*b*; 204*a* and 204*b*; and 205*a* and 205*b* are disposed. The controller 40 switches the selector valves 203*a* and 203*b*; 204*a* and 204*b*; and 205*a* and 205*b* to either one of the first position and the second position on the basis of signals from the pressure sensors 70*a* to 72*b* and the pressure sensors 200*a* to 202*b* and the target operation set in advance regarding the selector valves 203*a* to 205*b*.

Due to this, the drive system is allowed to have general-purpose versatility and front device operation by the MC can be carried out whatever kind of work mode is set in the controller 40.

On the other hand, it is also possible to cause the drive system to have a configuration specialized for the horizontal excavation illustrated in FIG. 8 and the position adjustment of the claw tip of the bucket 10 described above. In this case, it suffices that the pressure sensors 70*a* and 70*b*, the proportional solenoid valves 54*a* and 54*b*, the pressure sensors 200*a* and 200*b*, and the selector valves 203*a* and 203*b* are disposed only for the operation device 45*a* and the controller 40 switches the selector valves 203*a* and 203*b* to either one of the first position and the second position on the basis of signals from the pressure sensors 70*a* and 70*b* and the pressure sensors 200*a* and 200*b* and the target operation set in advance regarding the selector valves 203*a* and 203*b*.

This can also obtain the effects relating to the selector valves 203*a* and 203*b* in the above-described 1 to 3.

Second Embodiment

A second embodiment of the present invention will be described with reference to FIG. 10 and FIG. 11.

The second embodiment is different from the first embodiment in the configuration of the selector valve operation calculating section 212 in FIG. 5. The configuration other than it is the same as the first embodiment.

Figure 10:
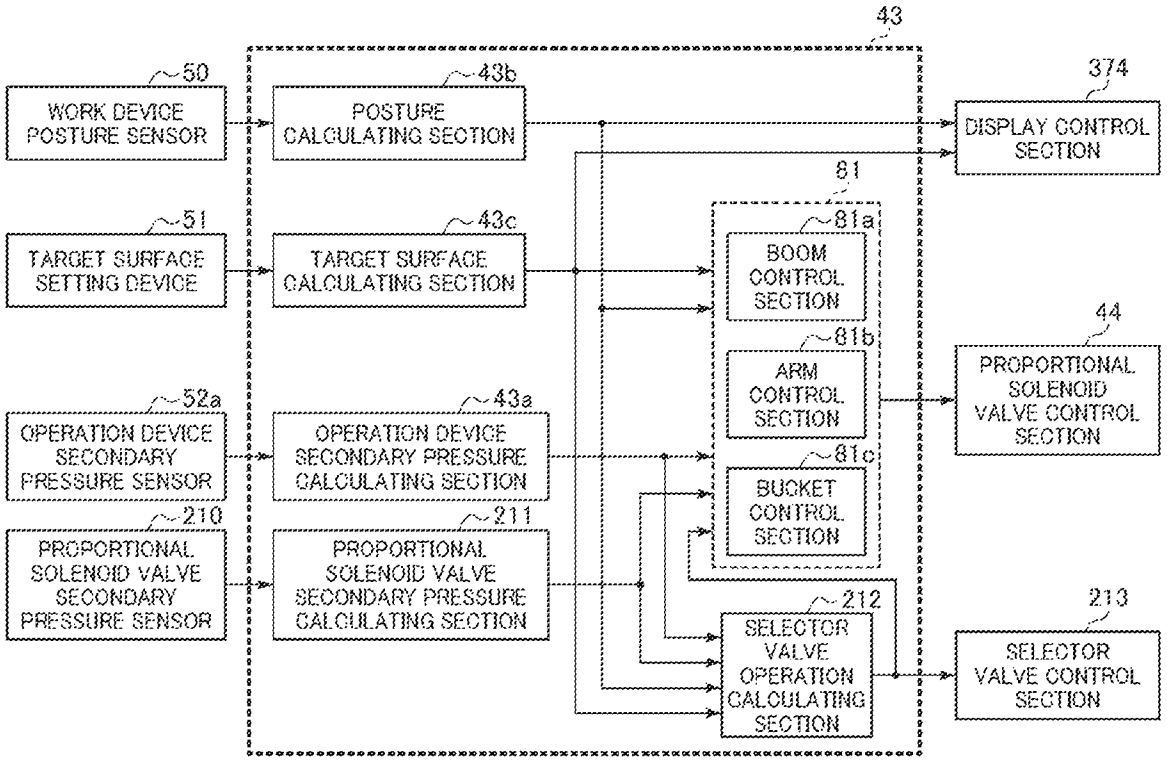
FIG. 10 is a functional block diagram of the MC control section similar to FIG. 5 in a second embodiment of the present invention.

FIG. 10 is a functional block diagram of the MC control section 43 similar to FIG. 5 in the present embodiment.

Figure 11:
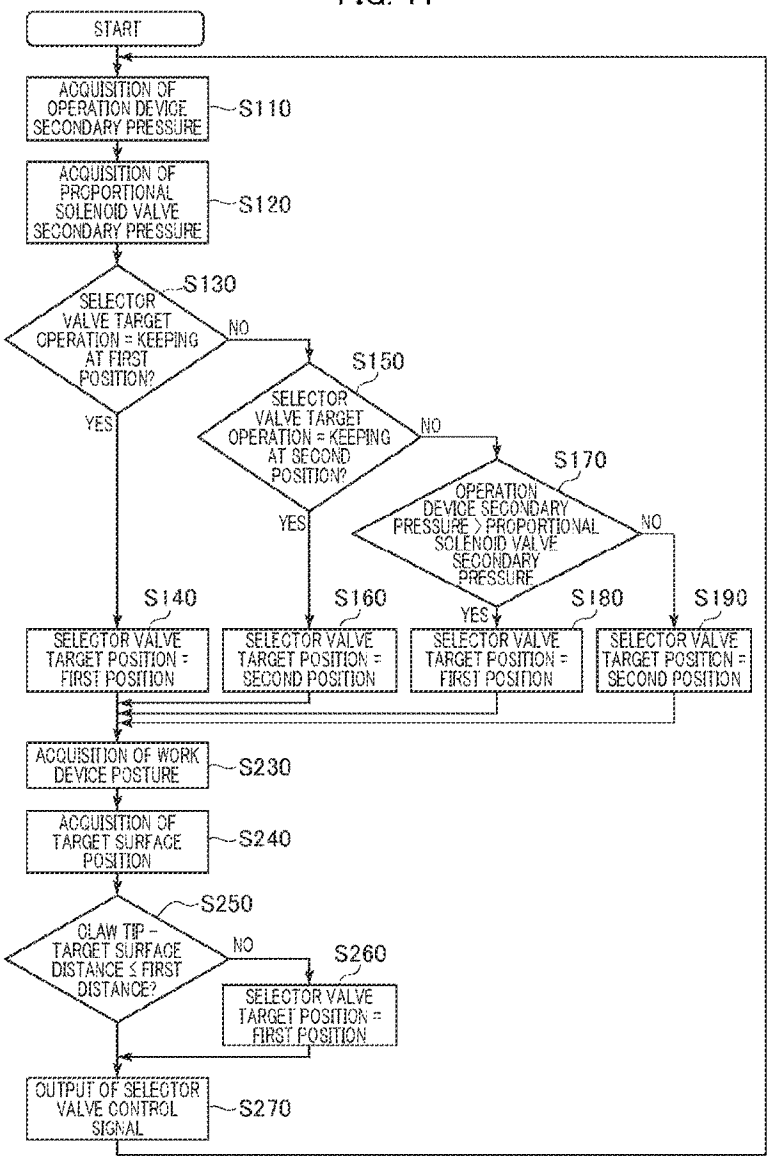
FIG. 11 is a diagram that illustrates a control flow of the selector valves in the selector valve operation calculating section in the second embodiment of the present invention and is similar to FIG. 6.

FIG. 11 is a diagram that illustrates a control flow of the selector valves 203*a* to 205*b* in the selector valve operation calculating section 212 in the present embodiment and is similar to FIG. 6.

The difference between FIG. 5 and FIG. 6 will be described below.

<Controller>

In FIG. 10, to the selector valve operation calculating section 212 of the controller 40, the outputs of the posture calculating section 43*b* and the target surface calculating section 43*c* are input in addition to the outputs of the operation device secondary pressure calculating section 43*a* and the proportional solenoid valve secondary pressure calculating section 211. The selector valve operation calculating section 212 calculates the target switching position of the selector valve 203*a* to 205*b* as illustrated in FIG. 11, according to a condition defined in advance (for example, work mode of front device operation), at the time of operation of the operation device 45*a*, 45*b*, or 46*a*.

<Selector Valve Control Flow of Selector Valve Operation Calculating Section 212>

In FIG. 11, the processing of the steps S110 to S190 is the same as the first embodiment illustrated in FIG. 6. In the present embodiment, the following processing is further executed after the target position of the selector valve 203*a* to 205*b* is set in the step S140, S160, S180, or S190.

First, in a step S230, the selector valve operation calculating section 212 acquires the posture of the boom 8, the arm 9, and the bucket 10 calculated in the posture calculating section 43*b*.

In a step S240, the selector valve operation calculating section 212 acquires position information of a target surface calculated in the target surface calculating section 43*c*.

In a step S250, the selector valve operation calculating section 212 determines whether or not the distance between the target surface 60 and the claw tip of the bucket 10 is shorter than a first distance set in advance from the output of the posture calculating section 43*b* and the output of the target surface calculating section 43*c*. When it is determined in the step S250 that the distance between the target surface 60 and the claw tip of the bucket 10 is equal to or shorter than the first distance set in advance, progress to a step S270 is made. When it is determined in the step S250 that the distance between the target surface 60 and the claw tip of the bucket 10 is longer than the first distance set in advance, progress to a step S260 is made.

In the step S260, the selector valve operation calculating section 212 sets the target position of the selector valve 203*a* to 205*b* to the first position. That is, even in the state in which the MC is valid, the target position of the selector valve 203*a* to 205*b* is set to the first position when the claw tip of the bucket 10 is separate from the target surface 60 by the first distance set in advance or longer.

In the step S270, the selector valve operation calculating section 212 outputs the target position of the selector valve 203*a* to 205*b* to the selector valve control section 213.

As above, in the present embodiment, the controller 40 calculates the distance between a control point of the work device 1A (for example, claw tip of the bucket 10) and the excavation target surface on the basis of signals from the work device posture sensor 50 (boom angle sensor 30, arm angle sensor 31, bucket angle sensor 32, and machine body inclination angle sensor 33). The controller 40 keeps the selector valve 203*b* (second selector valve) at the first position when the distance between the control point and the excavation target surface is longer than the first distance set in advance, and switches the selector valve 203*b* (second selector valve) to the second position when the distance between the control point and the excavation target surface becomes equal to or shorter than the first distance.

<Operation>

Similarly to the first embodiment, description will be made about operator operation and operation of the controller 40 (actuator control section 81 and selector valve operation calculating section 212) in the case in which, in the operation of the position adjustment of the claw tip of the bucket 10 to the target surface 60 by the MC in FIG. 9, the front work device 1A makes transitions from the state S4 (FIG. 9: distance between the claw tip of the bucket 10 and the target surface 60>first distance) to the state S5 (FIG. 9: distance between the claw tip of the bucket 10 and the target surface 60=first distance) and to the state S6 (FIG. 9: distance between the claw tip of the bucket 10 and the target surface 60<first distance).

During the state from the state S4 to the state S6 in FIG. 9, the operator operates only the operation lever 1*a* and inputs boom lowering operation.

In the state S4 to the state S6 in FIG. 9, on the basis of the second target operation (keeping at the second position) set in advance regarding the selector valve 203*b*, NO is determined in the step S130 in FIG. 11 regarding the selector valve 203*b* and YES is determined in the step S150. Then, the target position of the selector valve 203*b* is set to the second position in the step S160.

In the state S4, the distance between the target surface 60 and the claw tip of the bucket 10 is longer than the first distance. Therefore, NO is determined in the step S250 in FIG. 11 and the target position of the selector valve 203*b* is rewritten to the first position in the step S260. Due to this, in the state in which the distance between the claw tip of the bucket 10 and the target surface 60>first distance is satisfied, in which there is no fear of entry of the claw tip of the bucket 10 into the target surface 60, the selector valve 203*b* is controlled to the first position and therefore the pressure of the secondary port side of the operation device 45*a* (operation pilot pressure) is introduced to the hydraulic drive section 150*b* of the flow control valve 15*a* without passing through the proportional solenoid valve 54*b*. Thus, pressure loss as in the conventional case in which the operation pilot pressure passes through the proportional solenoid valve does not occur, thus the responsiveness of the hydraulic actuator 5 to operation of the operation device 45*a* can be improved and operability equivalent to that of a work machine that does not have MC functions can be ensured.

Furthermore, in the state S4, since the position of the selector valve 203*b* is the first position, NO is determined in the step S440 in FIG. 7. Then, in the step S470, the control pilot pressure equal to the operation pilot pressure of boom lowering operation calculated in the operation device secondary pressure calculating section 43*a* is calculated as the target pilot pressure on the basis of the first target operation of the proportional solenoid valve 54*b* set in advance, and the target pilot pressure is output from the boom control section 81*a*. Thereby, the pressure of the secondary port side of the proportional solenoid valve 54*b* (control pilot pressure) is controlled to become equal to the operation pilot pressure of the operation pilot line 144*b* of the operation device 45*a*.

In the state S5, the distance between the target surface 60 and the claw tip of the bucket 10 is the first distance. Therefore, YES is determined in the step S250 in FIG. 11 and the target position of the selector valve 203*b* remains at the second position set in the step S160. Thus, the selector valve 203*b* is switched from the first position to the second position in the state S5. At this time, the pressure of the secondary port side of the proportional solenoid valve 54*b* (control pilot pressure) is equal to the operation pilot pressure of the operation pilot line 144*b* of the operation device 45*a*. Therefore, sudden variation in the pressure that acts on the hydraulic drive section 150*b* of the flow control valve 15*a* does not occur at the moment of the switching of the selector valve 203*b* and shock to the front work device 1A can be suppressed.

<Effects>

According to the present embodiment, while operability equivalent to that of a machine that is not equipped with MC functions is ensured in the state in which there is no fear of entry of the claw tip of the bucket 10 into the target surface 60, the MC can be carried out in the state in which there is a fear of entry of the claw tip of the bucket 10 into the target surface 60. Moreover, the switching thereof can be automatically carried out without operation of a switch or the like by the operator. Furthermore, the occurrence of shock at the moment of switching of the selector valve 203*a* to 205*b* can be suppressed and it is possible to continue to smoothly operate the front work device 1A.

Third Embodiment

Figure 12:
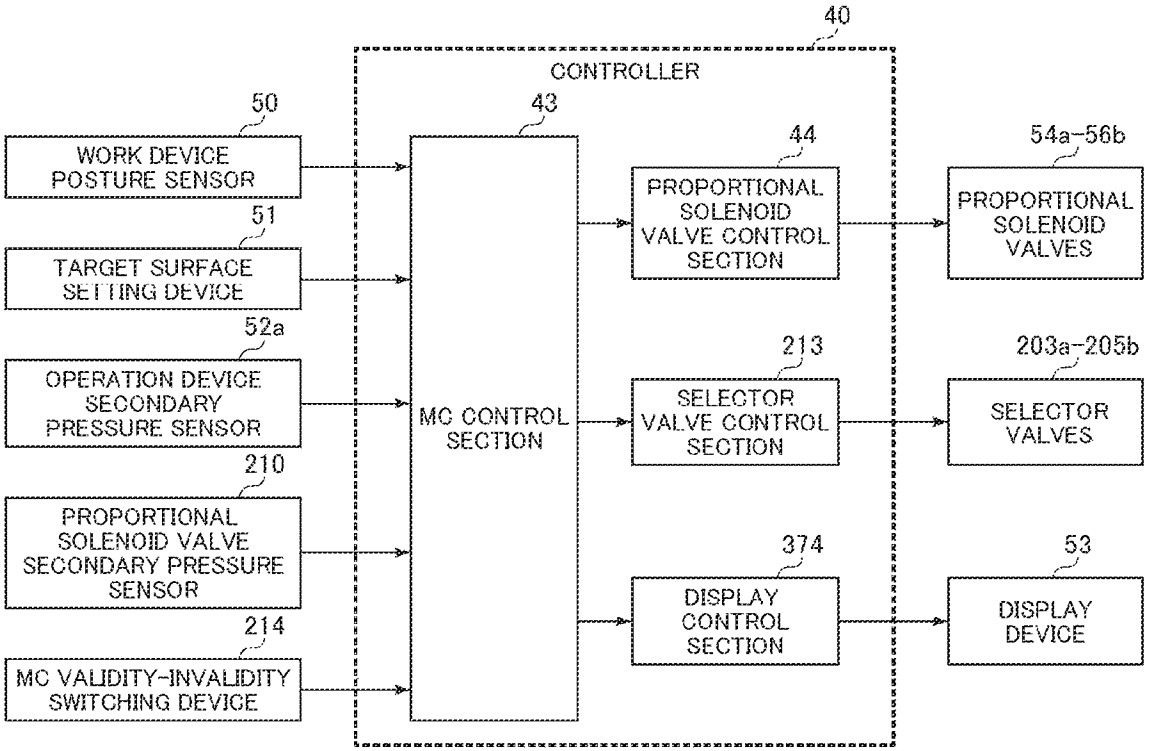
FIG. 12 is a functional block diagram of the controller in a third embodiment of the present invention.
Figure 13:
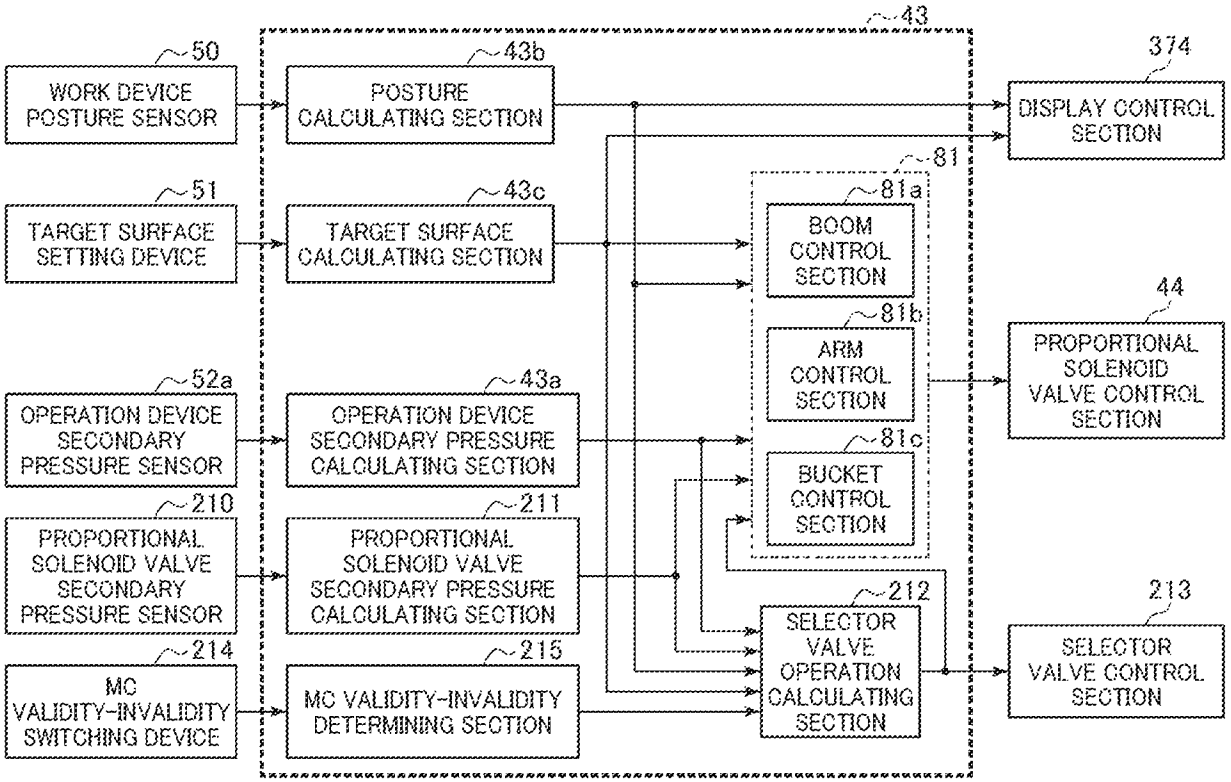
FIG. 13 is a functional block diagram of the MC control section in FIG. 12.
Figure 14:
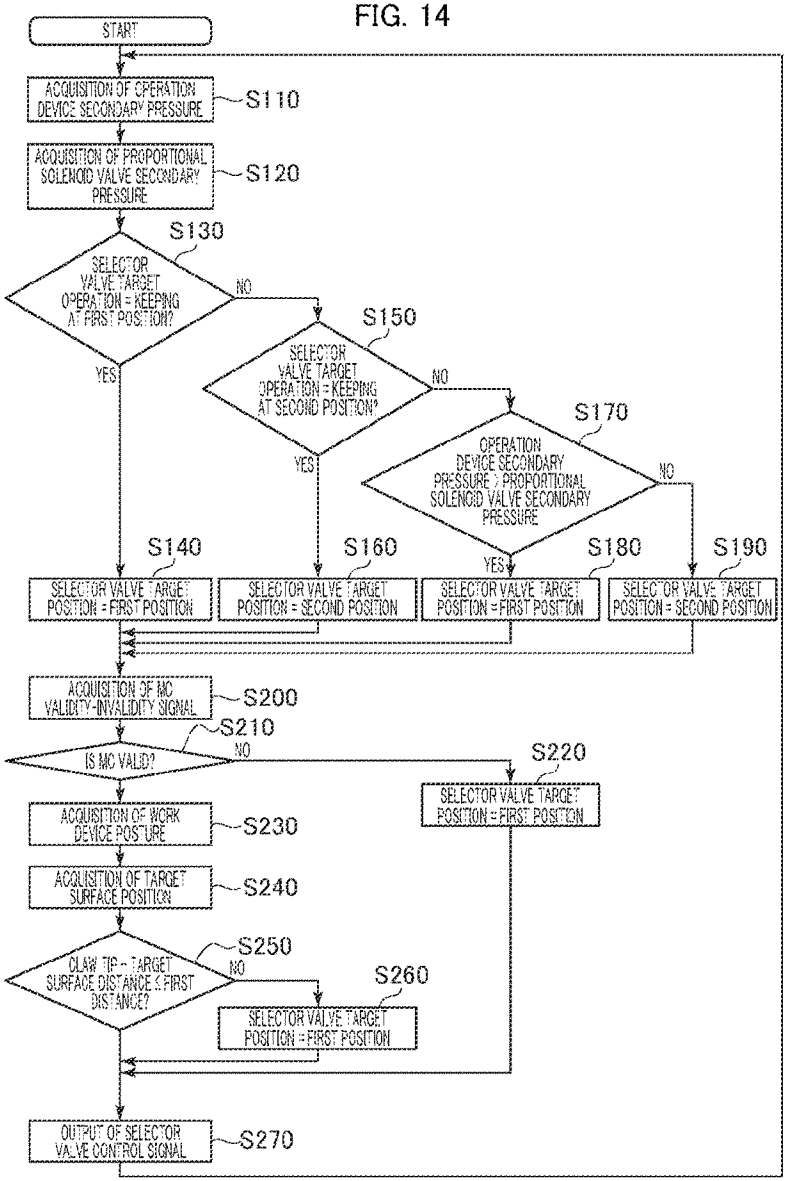
FIG. 14 is a diagram illustrating a control flow of the selector valves in the selector valve operation calculating section in the third embodiment of the present invention.

A third embodiment of the present invention will be described with reference to FIG. 12, FIG. 13, and FIG. 14. FIG. 12, FIG. 13, and FIG. 14 are diagrams obtained by changing part of FIG. 4, FIG. 5, and FIG. 6 and the difference will be described below.

<Basic Configuration>

A hydraulic excavator according to the third embodiment includes an MC validity-invalidity switching device 214 for alternatively selecting validity or invalidity (ON or OFF) of the MC.

<Controller 40>

FIG. 12 is a functional block diagram of the controller 40. Output from the MC validity-invalidity switching device 214 is input to the MC control section 43 of the controller 40. FIG. 13 is a functional block diagram of the MC control section 43 in FIG. 12.

The MC control section 43 includes an MC validity-invalidity determining section 215 in addition to the operation device secondary pressure calculating section 43*a*, the posture calculating section 43*b*, the target surface calculating section 43*c*, the boom control section 81*a*, the arm control section 81*b*, the bucket control section 81*c*, the proportional solenoid valve secondary pressure calculating section 211, and the selector valve operation calculating section 212. To the selector valve operation calculating section 212, the output of the MC validity-invalidity determining section 215 is input in addition to the outputs of the operation device secondary pressure calculating section 43*a*, the proportional solenoid valve secondary pressure calculating section 211, the posture calculating section 43*b*, and the target surface calculating section 43*c*.

The MC validity-invalidity determining section 215 determines whether a signal of the MC validity-invalidity switching device 214 is valid (ON) or invalid (OFF) on the basis of the input from the MC validity-invalidity switching device 214.

The selector valve operation calculating section 212 calculates the target position of the selector valves 203*a* to 205*b*, according to a condition defined in advance (for example, work mode of front device operation) on the basis of the outputs of the operation device secondary pressure calculating section 43*a*, the posture calculating section 43*b*, the target surface calculating section 43*c*, the proportional solenoid valve secondary pressure calculating section 211, and the MC validity-invalidity determining section 215.

<Selector Valve Control Flow of Selector Valve Operation Calculating Section 212>

FIG. 14 is a diagram illustrating a control flow of the selector valves 203*a* to 205*b* in the selector valve operation calculating section 212 in the present embodiment.

In FIG. 14, the processing of the steps S110 to S190 is the same as the first embodiment illustrated in FIG. 6 and the processing of the steps S230 to S270 is the same as the second embodiment illustrated in FIG. 11. In the present embodiment, after the target position of the selector valve 203*a* to 205*b* is set in the step S140, S160, S180, or S190, the following processing is executed before the processing of the step S210 to the step S270 is executed.

In a step S200, the selector valve operation calculating section 212 acquires the signal of the MC validity-invalidity switching device 214 determined in the MC validity-invalidity determining section 215.

In the step S210, the selector valve operation calculating section 212 determines whether or not the signal of the MC validity-invalidity switching device 214 acquired in the step S200 is valid. When it is determined that the signal is valid in the step S210, progress to a step S230 is made. When it is determined that the signal is other than valid in the step S210, progress to a step S220 is made.

In the step S220, the selector valve operation calculating section 212 sets the target position of the selector valves 203*a* to 205*b* to the first position. That is, when the signal of the MC validity-invalidity switching device 214 is other than valid, the target position of the selector valves 203*a* to 205*b* is set to the first position irrespective of the target operation set in advance.

As above, the work machine of the present embodiment further includes the MC validity-invalidity switching device 214 (switching device) that outputs the signal to carry out switching between validity and invalidity of control of the controller 40. The controller 40 rewrites the target position of the selector valves 203*a* and 203*b* (first and second selector valves) to the first position when the signal to make the control of the controller 40 invalid is input from the MC validity-invalidity switching device 214.

<Operation and Effects>

In the hydraulic excavator configured as above, even when the work mode of front device operation is set in the controller 40, the position of the selector valves 203*a* to 205*b* becomes the first position through setting of the MC validity-invalidity switching device 214 to invalidity (OFF) by the operator, and the pressures of the secondary port side of the operation devices 45*a*, 45*b*, and 46*a* (operation pilot pressures) are introduced to the hydraulic drive sections 150*a* to 152*b* of the flow control valves 15*a*, 15*b*, and 15*c* without passing through the proportional solenoid valves 54*a* to 56*b*. Thus, when the MC is not carried out, pressure loss as in the conventional case in which the operation pilot pressure passes through the proportional solenoid valve does not occur in all of boom raising operation, boom lowering operation, arm crowding operation, arm dumping operation, bucket crowding operation, and bucket dumping operation. Thus, the responsiveness of the hydraulic actuators 5, 6, and 7 to operation of the operation devices 45*a*, 45*b*, and 46*a* can be improved and operability equivalent to that of a work machine that does not have MC functions can be ensured.

In the present embodiment, the MC validity-invalidity switching device 214 for alternatively selecting validity or invalidity (ON or OFF) of the MC is disposed in the hydraulic excavator according to the second embodiment. However, the MC validity-invalidity switching device 214 may be disposed in the hydraulic excavator according to the first embodiment and the same effects are obtained also by this.

DESCRIPTION OF REFERENCE CHARACTERS

1A: Front work device (work device)
5: Boom cylinder (hydraulic actuator)
6: Arm cylinder (hydraulic actuator)
7: Bucket cylinder (hydraulic actuator)
8: Boom
9: Arm
10: Bucket
15*a*, 15*b*, 15*c*: Flow control valve
30: Boom angle sensor (work device posture sensor 50)
31: Arm angle sensor (work device posture sensor 50)
32: Bucket angle sensor (work device posture sensor 50)
40: Controller
43: MC control section
43*a*: Operation device secondary pressure calculating section
43*b*: Posture calculating section
43*c*: Target surface calculating section
44: Proportional solenoid valve control section
45*a*: Operation device for the boom
45*b*: Operation device for the bucket
46*a*: Operation device for the arm
50: Work device posture sensor
51: Target surface setting device
52*a*: Operation device secondary pressure sensor
54*a* to 56*b*: Proportional solenoid valve
70*a* to 72*b*: Pressure sensor (operation pressure sensor)
200*a* to 202*b*: Pressure sensor (control pressure sensor)
81: Actuator control section
81*a*: Boom control section
81*b*: Arm control section
81*c*: Bucket control section
134*a* to 136*b*: Secondary port (output port)
203*a* to 205*b*: Selector valve
210: Proportional solenoid valve secondary pressure sensor
211: Proportional solenoid valve secondary pressure calculating section
212: Selector valve operation calculating section
213: Selector valve control section
214: MC validity-invalidity switching device (switching device)
215: MC validity-invalidity determining section
374: Display control section

The invention claimed is:

1. A work machine comprising:

a work device;

a plurality of hydraulic actuators that drive the work device;

a plurality of operation devices that generate a plurality of operation pilot pressures to instruct operations of the plurality of hydraulic actuators;

a plurality of flow control valves that are driven by the plurality of operation pilot pressures and control flow rates of hydraulic fluids supplied to the plurality of hydraulic actuators;

a plurality of proportional solenoid valves that generate a plurality of control pilot pressures independently of the plurality of operation devices;

a plurality of operation pressure sensors that sense the plurality of operation pilot pressures generated by the plurality of operation devices;

a work device posture sensor that senses posture of the work device; and a controller that controls the plurality of proportional solenoid valves on a basis of signals from the plurality of operation pressure sensors and the work device posture sensor, the plurality of operation devices including a first operation device that instructs operation of a first hydraulic actuator in the plurality of hydraulic actuators, the plurality of flow control valves including a first flow control valve that is driven by an operation pilot pressure generated by the first operation device and controls a flow rate of a hydraulic fluid supplied to the first hydraulic actuator, the first operation device having a first output port that outputs a first operation pilot pressure to instruct operation of the first hydraulic actuator in a first direction and a second output port that outputs a second operation pilot pressure to instruct operation of the first hydraulic actuator in a second direction, the plurality of operation pressure sensors having a first operation pressure sensor that senses the first operation pilot pressure and a second operation pressure sensor that senses the second operation pilot pressure, wherein the plurality of proportional solenoid valves have a first proportional solenoid valve that generates a first control pilot pressure to instruct operation of the first hydraulic actuator in the first direction and a second proportional solenoid valve that generates a second control pilot pressure to instruct operation of the first hydraulic actuator in the second direction, the work machine further comprises a plurality of control pressure sensors that sense the plurality of control pilot pressures generated by the plurality of proportional solenoid valves and include a first control pressure sensor that senses the first control pilot pressure generated by the first proportional solenoid valve and a second control pressure sensor that senses the second control pilot pressure generated by the second proportional solenoid valve, a first selector valve disposed between the first output port of the first operation device and the first flow control valve and between the first proportional solenoid valve and the first flow control valve, and a second selector valve disposed between the second output port of the first operation device and the first flow control valve and between the second proportional solenoid valve and the first flow control valve, the first selector valve has a first position to interrupt connection between the first proportional solenoid valve and the first flow control valve and connect the first output port of the first operation device to the first flow control valve and a second position to interrupt connection between the first output port of the first operation device and the first flow control valve and connect the first proportional solenoid valve to the first flow control valve, the second selector valve has a first position to interrupt connection between the second proportional solenoid valve and the first flow control valve and connect the second output port of the first operation device to the first flow control valve and a second position to interrupt connection between the second output port of the first operation device and the first flow control valve and connect the second proportional solenoid valve to the first flow control valve, and the controller is configured to switch the first and second selector valves to either one of the first position and the second position on a basis of signals from the first and second operation pressure sensors and the first and second control pressure sensors and a target operation set in advance regarding the first and second selector valves.

2. The work machine according to claim 1, wherein the controller is configured to, as the target operation set in advance regarding the first and second selector valves, set one of first target operation of keeping at the first position, second target operation of keeping at the second position, and third target operation of switching to one of the first position and the second position to introduce, to the first flow control valve, a higher pressure of the first operation pilot pressure and the first control pilot pressure and a higher pressure of the second operation pilot pressure and the second control pilot pressure, and set target position of the first and second selector valves on a basis of the set target operation to switch the first and second selector valves to either one of the first position and the second position.

3. The work machine according to claim 1, wherein the controller is configured to, as target operation of the first and second proportional solenoid valves, set first target operation of equalizing the first and second control pilot pressures sensed by the first and second control pressure sensors to the first and second operation pilot pressures sensed by the first and second operation pressure sensors, respectively, when the first and second selector valves exist at the first position and set second target operation based on automatic control in advance when the first and second selector valves exist at the second position, and set a target pilot pressure of the first and second proportional solenoid valves on a basis of the set target operation, and control the first and second proportional solenoid valves.

4. The work machine according to claim 1, wherein the controller is configured to calculate distance between a control point of the work device and an excavation target surface on a basis of the signal from the work device posture sensor, and keep the second selector valve at the first position when the distance between the control point and the excavation target surface is longer than a first distance set in advance, and switch the second selector valve to the second position when the distance between the control point and the excavation target surface becomes equal to or shorter than the first distance, and as target operation of the second proportional solenoid valve, set first target operation of equalizing the second control pilot pressure sensed by the second control pressure sensor to the second operation pilot pressure sensed by the second operation pressure sensor when the second selector valve exists at the first position and set second target operation based on automatic control when the second selector valve exists at the second position, and set a target pilot pressure of the second proportional solenoid valve on a basis of the set target operation to control the second proportional solenoid valve.

5. The work machine according to claim 1, wherein the first and second operation pressure sensors, the first and second proportional solenoid valves, the first and second control pressure sensors, and the first and second selector valves are disposed for each of the plurality of operation devices, and the controller is configured to switch the first and second selector valves to either one of the first position and the second position on a basis of signals from the first and second operation pressure sensors and the first and second control pressure sensors and the target operation set in advance regarding the first and second selector valves.

6. The work machine according to claim 5, wherein the controller is configured for each of the plurality of operation devices to set, as the target operation set in advance regarding the first and second selector valves, one of first target operation of keeping at the first position, second target operation of keeping at the second position, and third target operation of switching to one of the first position and the second position to introduce, to each of the plurality of flow control valves, a higher pressure of the first operation pilot pressure and the first control pilot pressure and a higher pressure of the second operation pilot pressure and the second control pilot pressure, and set a target position of the first and second selector valves on a basis of the set target operation to switch the first and second selector valves to either one of the first position and the second position.

7. The work machine according to claim 1, further comprising a switching device that outputs a signal for carrying out switching between validity and invalidity of control of the controller, wherein the controller is configured to rewrite a target position of the first and second selector valves to the first position when the signal to make the control of the controller invalid is input from the switching device.

* * * * *